US008686663B2

(12) United States Patent
Ishikita et al.

(10) Patent No.: US 8,686,663 B2
(45) Date of Patent: Apr. 1, 2014

(54) LIGHTING SYSTEM AND CONTROL METHOD THEREOF

(75) Inventors: Toru Ishikita, Kanagawa-ken (JP); Naoko Iwai, Kanagawa-ken (JP); Makoto Kono, Kanagawa-ken (JP); Hiroya Kan, Kanagawa-ken (JP); Takao Kowada, Kanagawa-ken (JP); Kiyoteru Kosa, Kanagawa-ken (JP); Hitoshi Kawano, Kanagawa-ken (JP); Yosuke Saito, Kanagawa-ken (JP)

(73) Assignee: Toshiba Lighting & Technology Corporation, Kanagawa (JP)

( * ) Notice: Subject to any disclaimer, the term of this patent is extended or adjusted under 35 U.S.C. 154(b) by 0 days.

(21) Appl. No.: 13/599,801

(22) Filed: Aug. 30, 2012

(65) Prior Publication Data

US 2013/0063045 A1 Mar. 14, 2013

(30) Foreign Application Priority Data

Sep. 8, 2011 (JP) ..... 2011-195884

(51) Int. Cl.
*H05B 37/02* (2006.01)

(52) U.S. Cl.
USPC ..... 315/296; 315/294; 315/297

(58) Field of Classification Search
None
See application file for complete search history.

(56) References Cited

U.S. PATENT DOCUMENTS 6,366,063 B1 * 4/2002 Sekii ..... 323/223
6,441,558 B1 * 8/2002 Muthu et al. ..... 315/149
7,015,655 B2 * 3/2006 Kamoi et al. ..... 315/291
7,750,582 B2 * 7/2010 Moriyasu et al. ..... 315/291
7,999,491 B2 * 8/2011 Peng et al. ..... 315/291
8,258,709 B2 * 9/2012 Moskowitz ..... 315/152
8,330,378 B2 * 12/2012 Maehara et al. ..... 315/151
8,436,549 B2 * 5/2013 Hasnain ..... 315/291
8,569,969 B2 * 10/2013 Moss ..... 315/291
2002/0047647 A1 * 4/2002 Noh ..... 315/312
2004/0113567 A1 * 6/2004 Yamauchi et al. ..... 315/291
2004/0183472 A1 * 9/2004 Kamoi et al. ..... 315/291
2005/0200306 A1 * 9/2005 Conway et al. ..... 315/291
2009/0079360 A1 * 3/2009 Shteynberg et al. ..... 315/291
2009/0243507 A1 * 10/2009 Lucero-Vera et al. ..... 315/291
2010/0060187 A1 * 3/2010 Newman et al. ..... 315/291
2010/0134020 A1 * 6/2010 Peng et al. ..... 315/133
2010/0244701 A1 * 9/2010 Chen et al. ..... 315/117
2011/0115407 A1 * 5/2011 Wibben et al. ..... 315/294
2011/0273095 A1 * 11/2011 Myers et al. ..... 315/119
2012/0038291 A1 * 2/2012 Hasnain ..... 315/294
2013/0134901 A1 * 5/2013 Park et al. ..... 315/294

FOREIGN PATENT DOCUMENTS

JP 2007-200723 8/2007

* cited by examiner

*Primary Examiner* — Crystal L Hammond
(74) *Attorney, Agent, or Firm* — Patterson & Sheridan, LLP

(57) ABSTRACT

A lighting system according to embodiments includes a first light source, a second light source, a first lighting circuit, a second lighting circuit, a signal input unit, and a control circuit. The first light source has a predetermined color temperature. The second light source has a color temperature which is different from that of the first light source. The first lighting circuit lights the first light source. The second lighting circuit lights the second light source. The signal input unit receives an external signal. The control circuit includes a first light source lighting control cycle which performs a predetermined lighting control of the first light source, and a second light source lighting control cycle which performs a predetermined lighting control of the second light source, controls the first and second lighting circuits so as to start the lighting control.

20 Claims, 18 Drawing Sheets

LIGHTING SYSTEM AND CONTROL METHOD THEREOF

CROSS-REFERENCE TO RELATED APPLICATION

This application is based upon and claims the benefit of priority from Japanese Patent Application No. 2011-195884, filed on Sep. 8, 2011; the entire contents of which are incorporated herein by reference.

FIELD

Embodiments described herein relate generally to a lighting system, and a control method thereof.

BACKGROUND

In a color-changing light emitting diode (LED) lighting system in the related art which includes a plurality of light emitting diodes the luminous color of which is different, each of the small light emitting diodes is attached in order to change the light source color of the lighting system easily, an optical output of each light emitting diode is set according to a rotation angle of a rotating base which is rotatably provided with respect to a main body of the lighting system, and each of the light emitting diodes is lit using a set optical output.

However, in the color-changing LED lighting system in the related art, there is a concern that, even if a desired luminous color is set by operating the rotating base, the desired luminous color may not be obtained again after setting a different luminous color.

DETAILED DESCRIPTION

First Embodiment

Figure 1:
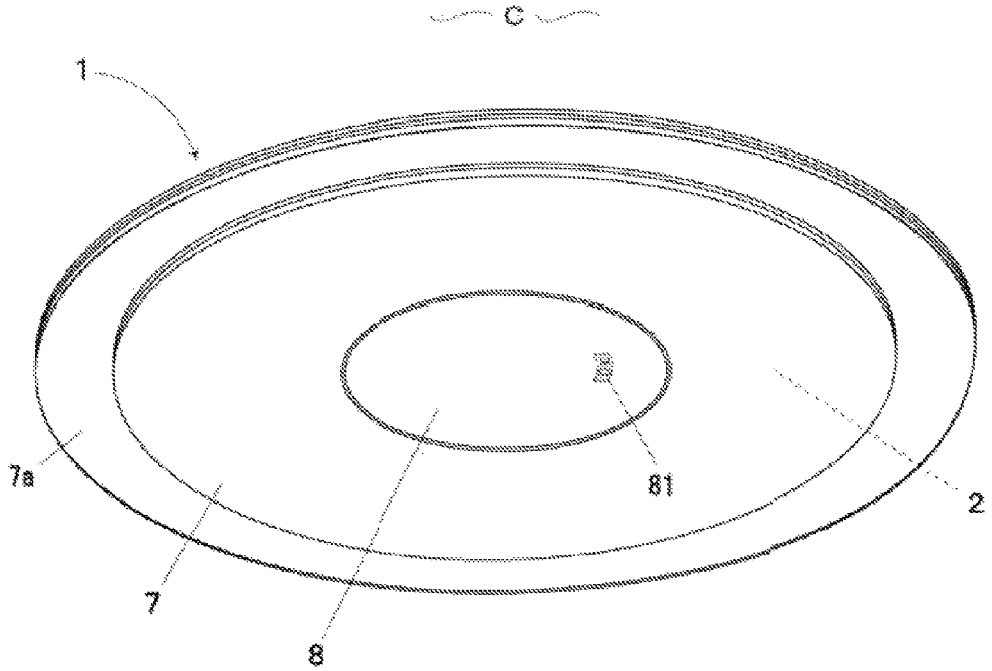
FIG. 1 is a perspective view which shows a lighting system according to a first example.
Figure 1:
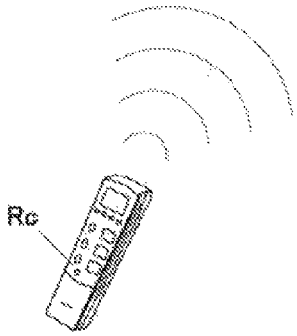

A lighting system according to a first embodiment includes a first light source, a second light source, a first lighting circuit, a second lighting circuit, a signal input unit, and a control circuit. The first light source has a predetermined color temperature. The second light source has a color temperature which is different from that of the first light source. The first lighting circuit is configured to light the first light source. The second lighting circuit configured to light the second light source. The signal input unit receives an external signal. The control circuit includes a first light source lighting control cycle and a second light source lighting control cycle. The first light source lighting control cycle performs predetermined lighting control of the first light source. The second light source lighting control cycle performs a predetermined lighting control of the second light source. The control circuit controls the first and second lighting circuits so as to start lighting control based on the first and second light source lighting control cycles by a first signal which is input to the signal input unit, and controls the first and second lighting circuits so as to stop the lighting control based on the first and second light source lighting control cycles by a second signal which is input to the signal input unit.

Second Embodiment

In a lighting system according to a second embodiment, the control circuit according to the first embodiment may make a ratio between an optical output of the first light source and an optical output of the second light source when stopping lighting control based on the first and second light source lighting control cycles constant by the second signal which is input to the signal input unit, and may perform dimming control of the first and second light sources on the basis of a dimming signal which is input to the signal input unit keeping the ratio constant.

Third Embodiment

In a lighting system according to a third embodiment, the control circuit according to the first embodiment may store control target values of the first and second light source lighting control cycles when a lighting control based on the first and second light source lighting control cycles is stopped by the second signal which is input to the signal input unit, and may control the first and second lighting circuits on the basis of the stored control target values of the first and second light source lighting control cycles by a third signal which is input to the signal input unit.

Fourth Embodiment

In a lighting system according to a fourth embodiment, the control circuit according to the second embodiment may stop a lighting control based on the first and second light source lighting control cycles by the second signal which is input to the signal input unit, may store the control target values of the first and second light source lighting control cycles after performing dimming control, and may control the first and second lighting circuits on the basis of the stored control target values of the first and second light source lighting control cycles by a third signal which is input to the signal input unit.

Fifth Embodiment

In a lighting system according to a fifth embodiment, the control circuit according to any one of the first to fourth embodiments may control the second lighting circuit so that the optical output of the second light source decreases on the basis of the second light source lighting control cycle, when the first lighting circuit is controlled so that the optical output of the first light source increases on the basis of the first light source lighting control cycle, and may control the second lighting circuit so that the optical output of the second light source increases on the basis of the second light source lighting control cycle, when the first lighting circuit is controlled so that the optical output of the first light source decreases on the basis of the first light source lighting control cycle.

Sixth Embodiment

A lighting system according to a sixth embodiment further includes a third light source, and a third lighting circuit in the lighting system according to any one of the first to fifth embodiments. The third light source has a color temperature which is different from those of the first and second light sources. The third lighting circuit is configured to light the third light source. The control circuit includes a third light source lighting control cycle performing a predetermined lighting control of the third light source, and gives an instruction for simultaneously performing all of lighting controls of an increase control, a decrease control, and a constant control of the optical output on the basis of the first, second, and third light source lighting control cycles by the first signal which is input to the signal input unit.

Hereinafter, the lighting system according to the embodiments will be described with reference to the drawings.

EXAMPLE 1

A lighting system according to an example 1a includes a first light source with a predetermined color temperature, a second light source with a color temperature which is different from that of the first light source, a first lighting circuit which lights the first light source, a second lighting circuit which lights the second light source, a signal input unit receiving an external signal, and a control circuit including a first light source lighting control cycle performing a predetermined lighting control of the first light source and a second light source lighting control cycle performing a predetermined lighting control of the second light source. The control circuit controls the first and second lighting circuits so as to start the lighting control based on the first and second light source lighting control cycles by the first signal which is input to the signal input unit, and controls the first and second lighting circuits so as to stop the lighting control based on the first and second light source lighting control cycles by the second signal which is input to the signal input unit.

A lighting system according to an example 1b is configured by the control circuit of the lighting system in the example 1a which makes a ratio between an optical output of the first light source and an optical output of the second light source when stopping a lighting control based on the first and second light source lighting control cycles constant by the second signal which is input to the signal input unit, and performs a dimming control of the first and second light sources on the basis of a dimming signal which is input to the signal input unit in the constant state, i.e. keeping the ratio constant.

A lighting system according to an example 1c is configured by the control circuit of the lighting system in the example 1a which stores control target values of the first and second light source lighting control cycles when a lighting control based on the first and second light source lighting control cycles is stopped by the second signal which is input to the signal input unit, and controls the first and second lighting circuits on the basis of the stored control target values of the first and second light source lighting control cycles by a third signal which is input to the signal input unit.

A lighting system according to an example 1d is configured by the control circuit of the lighting system in the example 1b which stops a lighting control based on the first and second light source lighting control cycles by the second signal which is input to the signal input unit, stores the control target values of the first and second light source lighting control cycles after being performed with a dimming control, and controls the first and second lighting circuits on the basis of the stored control target values of the first and second light source lighting control cycles by a third signal which is input to the signal input unit.

A lighting system according to an example 1e is configured by the control circuit of the lighting system in any one of the examples 1a to 1d which control the second lighting circuit so that the optical output of the second light source decreases on the basis of the second light source lighting control cycle, when the first lighting circuit is controlled so that the optical output of the first light source increases on the basis of the first light source lighting control cycle, and controls the second lighting circuit so that the optical output of the second light source increases on the basis of the second light source lighting control cycle, when the first lighting circuit is controlled so that the optical output of the first light source decreases on the basis of the first light source lighting control cycle.

A lighting system according to an example 1f is configured by the lighting system according to any one of the examples 1a to 1e which includes, a third light source which has a color temperature different from those of the first and second light sources; a third lighting circuit which lights the third light source, in which the control circuit includes a third light source lighting control cycle which performs a predetermined lighting control of the third light source, and gives an instruction for simultaneously performing all of lighting controls of an increase control, a decrease control, and a constant control of the optical output by any one of the first, second, and third lighting circuits on the basis of the first, second; and third light source lighting control cycles by the first signal which is input to the signal input unit.

Hereinafter, the example 1 (examples 1a to 1f) will be described with reference to drawings 1 to 19. FIGS. 1 to 14 show alighting system, and a wiring connection relationship due to lead wire or the like is omitted in each drawing. In addition, the same portions are given the same reference numerals, and repeated descriptions will be omitted.

The lighting system according to the example 1 is a system for general housing which is used by being attached to a ceiling hooking body as a wiring accessory which is provided on the unit attaching surface, and performs room lighting by light which is radiated from a light source including a plurality of light emitting elements mounted on a substrate.

In FIGS. 1 to 5, the lighting system includes a system main body 1, a light source unit 2, a lighting device 3, and a center member 4. The lighting system further includes an adaptor guide 5, an optical sensor (a first sensor) 6, a shade 7, a cover member 8, and an indirect light source unit 9. In addition, an adaptor A which is electrically and mechanically connected to a ceiling hooking body Cb which is provided at the ceiling surface C as the unit attaching surface (refer to FIG. 12) is further included. Further, a remote control transmitter Rc is included. Such a lighting system has an appearance of a circular round shape, the front surface side thereof is the irradiation surface of light, and the rear surface side is the attaching surface to the ceiling surface C.

As shown in FIGS. 2 to 5, the main body 1 is chassis which is circularly formed using a metal flat plate such as cold roll steel, and a circular opening 11 at which the adaptor guide 5 to be described later is formed approximately at the center portion thereof. The opening 11 is formed so as to have approximately the same shape as the appearance of the adaptor guide 5 by having a portion of the circular shape protruding outside.

The outer periphery side of the opening 11 has a protrusion 12 which is protruded to the rear surface side and has a rectangular shape the corner of which has an R-shape. In addition, a protrusion 13 of a circular annular shape protruded to the front surface side is formed at the outer periphery side of the protrusion 12. In addition, a protrusion 14 of a circular annular shape which is protruded to the rear surface side so as to be continuous to the protrusion 13 in the radius direction, in other words, to form a concave portion at the front surface side is formed at the outer periphery side of the protrusion 13.

The concave portion which is formed by the protrusion 14 is arranged with a shade receiving metal fitting 75 to which the shade 7 is detachably attached. These protrusions 12, 13, and 14 mainly function as attaching portions of members which are attached to the chassis, and have functions of reinforcing the strength of the chassis, and increasing a radiation surface area.

In addition, according to the embodiment, the main body 1 corresponds to the chassis, however, the main body may be the one which is referred to as a case, a reflective plate, or a base. In general, the main body means a member or a portion at which the light source unit 2 is directly, or indirectly arranged, and shall not be particularly limited.

Figure 2:
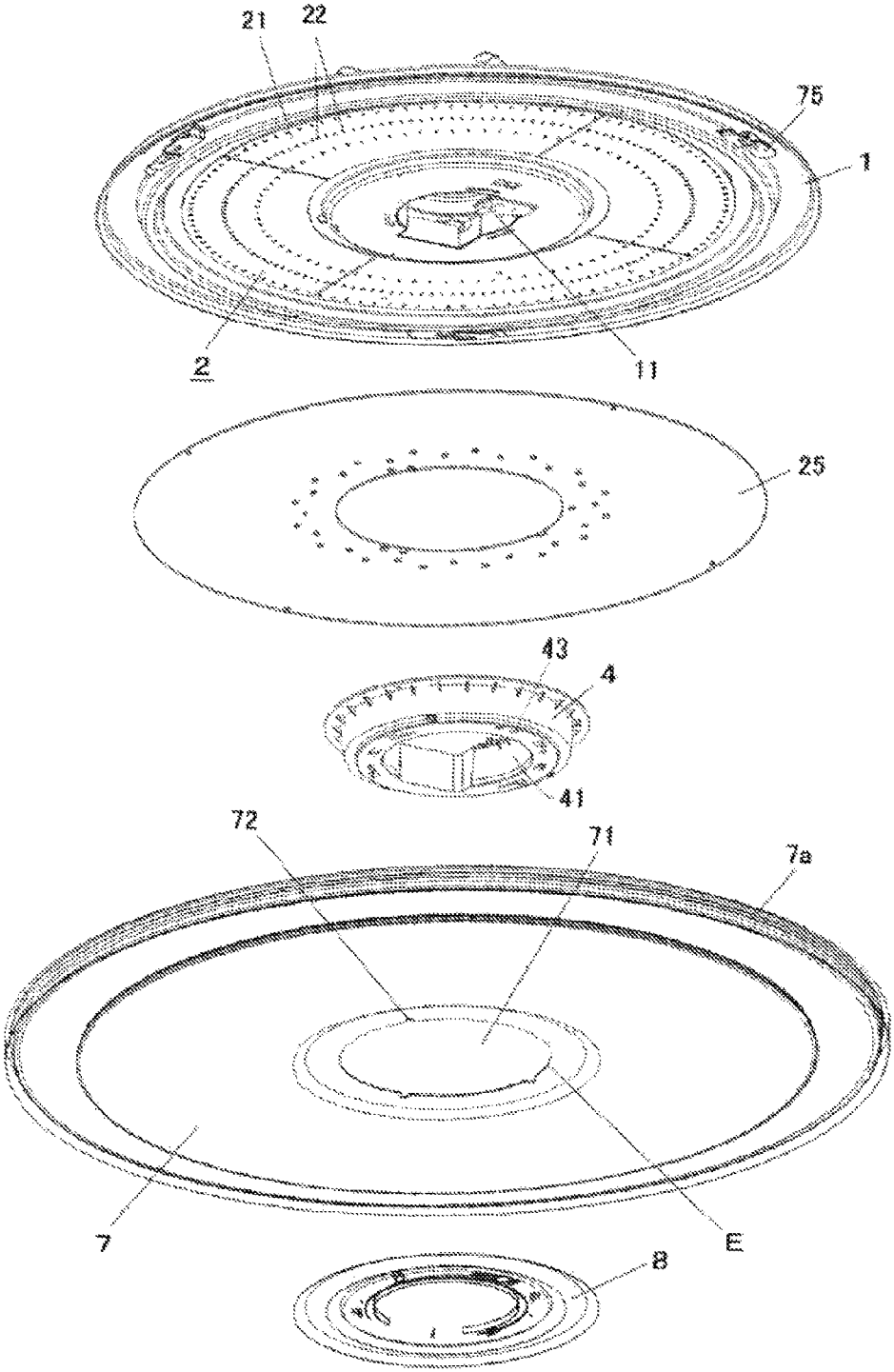
FIG. 2 is an exploded perspective view which shows the front surface side of the lighting system.
Figure 4:
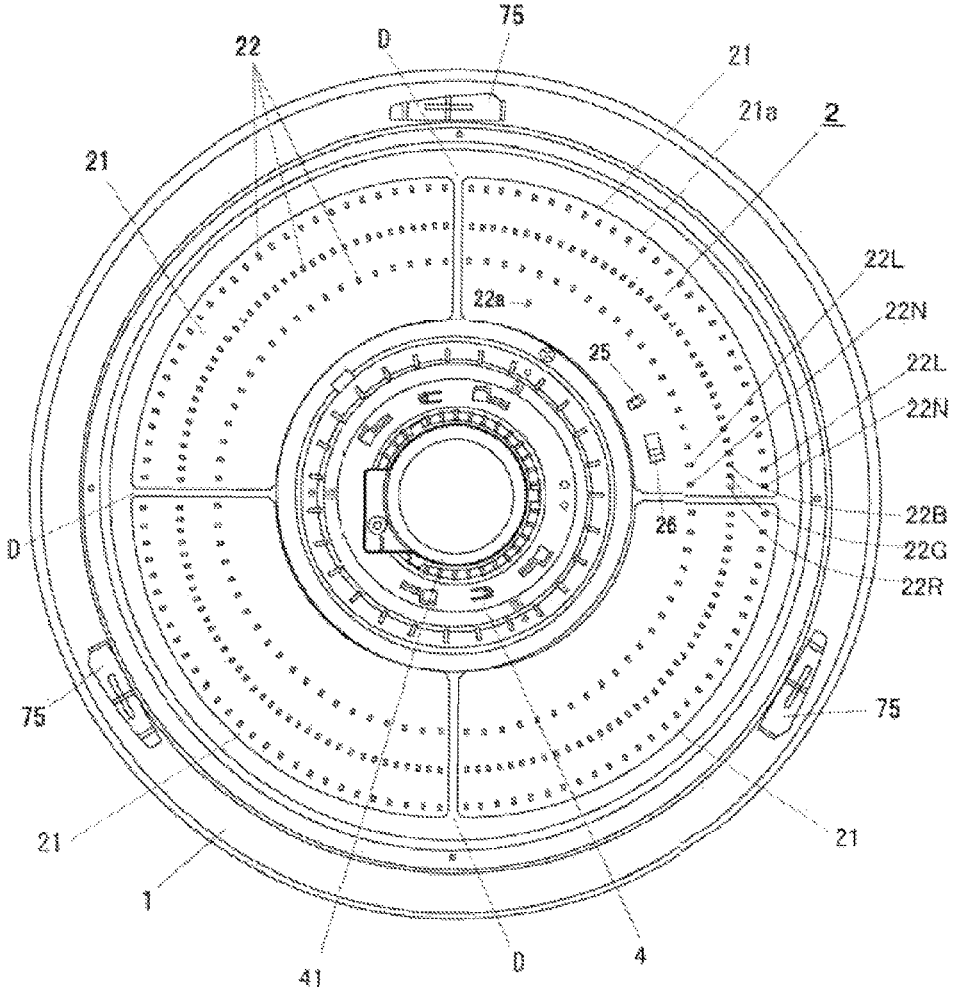
FIG. 4 is a plan view which shows the lighting system by detaching a shade and a cover of a light source unit.
Figure 5:
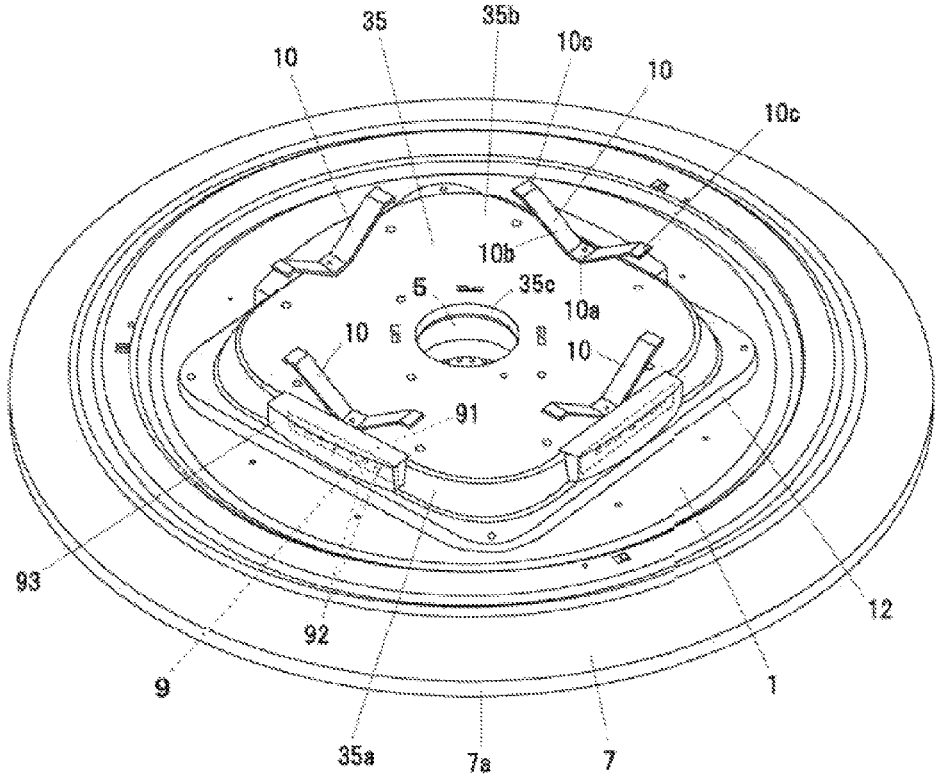
FIG. 5 is a perspective view which shows the rear surface side of the lighting system.
Figure 6:
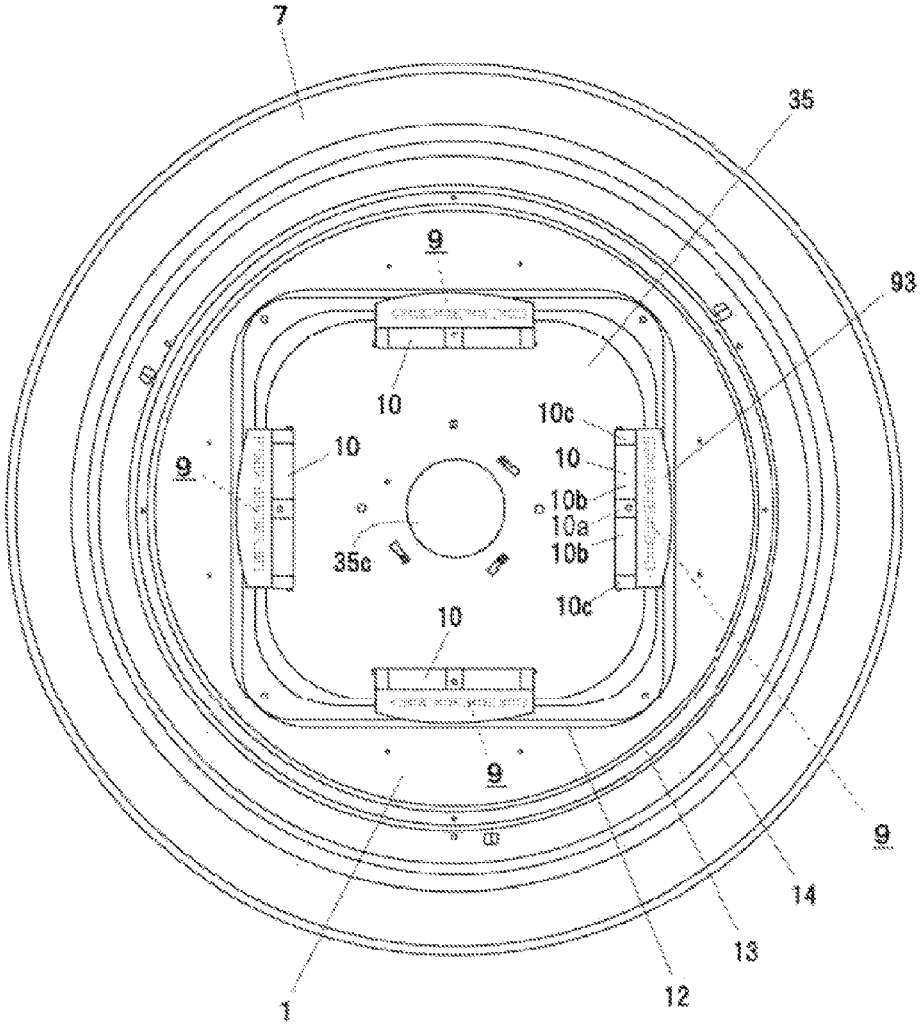
FIG. 6 is a plan view which shows the rear surface side of the lighting system.
Figure 12:
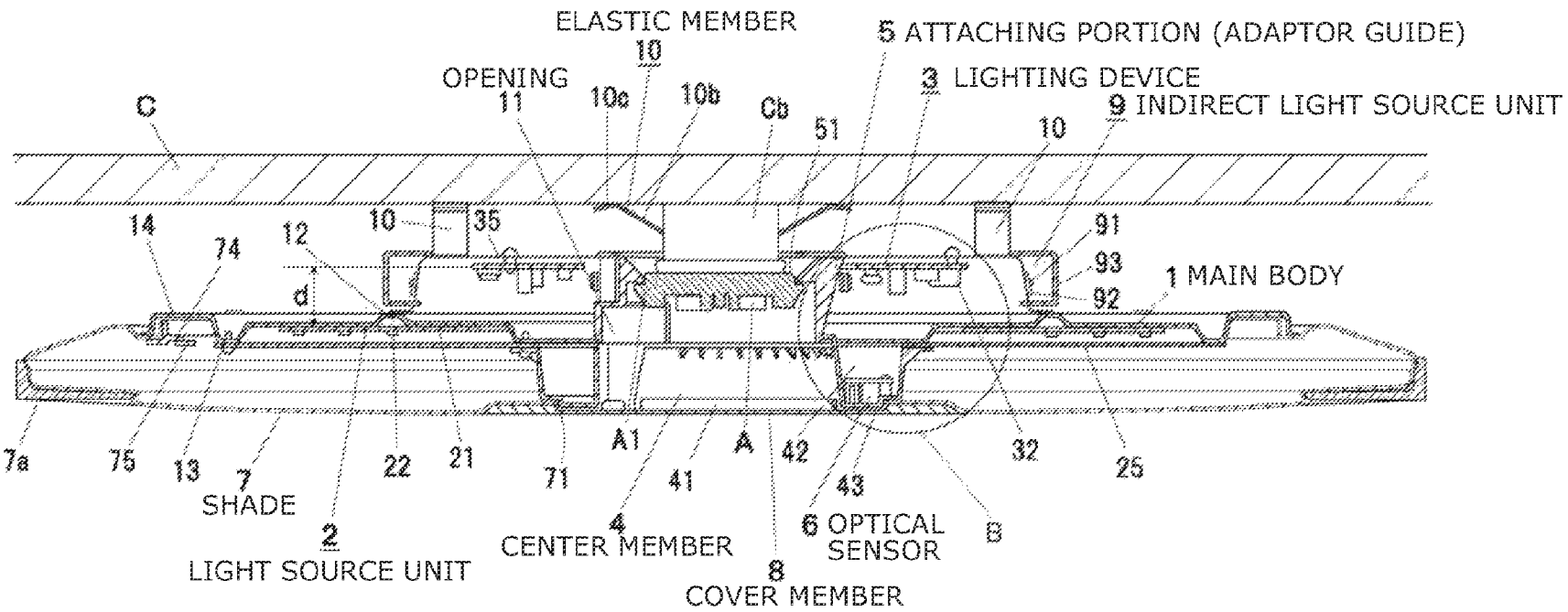
FIG. 12 is a cross-sectional view which shows a state where the lighting system is attached to a ceiling surface.

As shown in FIGS. 2, 4, and 12, the light source unit 2 includes a substrate 21, and a plurality of light emitting elements 22 which is mounted to the substrate 21. The substrate 21 is arranged with four arc-shaped substrates 21 with a predetermined width which are connected to each other, and is formed of approximately a circle shape as a whole. That is, the substrate 21 which is formed of approximately the circle shape as a whole is configured by a substrate 21 which is divided into four pieces.

In addition, a type of the light source which configures the light source unit 2 is not limited. For example, any of a fluorescent lamp, an HID lamp, a light emitting element 22 as the above described LED, and a lamp such as an EL (organic, inorganic) lamp, and a field emission lamp can be used. In addition, any of a combination of the same types, and different types can be used when color temperature are approximately the same.

By using such a divided substrate 21, it is possible to suppress a deformation of the substrate 21 by absorbing a thermal contraction in the division portion of the substrate 21. In addition, it is preferable to use the substrate 21 divided in a plurality, however, it is also preferable to use an approximately circle-shaped substrate of one piece which is integrally formed.

The substrate 21 is formed of a flat plate of glass epoxy resin (FR-4) as an insulating material, and the surface side thereof is formed with a wring pattern using copper foil. The light emitting element 22 is electrically connected to the wiring pattern. In addition, a white resist layer which functions as a reflective layer is applied onto the wiring pattern, that is, the surface of the substrate 21.

In addition, when the insulating material is used as a material of the substrate 21, it is possible to adopt a ceramic material, or a synthetic resin material. Further, when a metal material is used, it is possible to adopt a metal base substrate such as aluminum base plate with good thermal conductivity and excellent heat dissipation, and one surface of which is laminated with an insulating layer.

The light emitting element 22 is an LED, and a surface mount-type LED package. The plurality of LED packages is mounted in plural columns, according to the embodiment, in three columns on the periphery of an approximately concentric circle of different radius, along the peripheral direction of the circle-shaped substrate 21. That is, the LED packages are mounted over the column on the inner peripheral side, the column on the outer peripheral side, and a middle column between the column on the inner peripheral side and the column on the outer peripheral side.

The LED package is configured by LED chips which are arranged in a cavity which is formed of ceramic, or synthetic resin, schematically, and transparent resin for molding such as epoxy resin, or silicone resin for sealing the LED chips.

A light emitting element 22N the luminous color of which is neutral white, and a light emitting element 22L of an incandescent lamp-color are used in the light emitting elements 22 which are mounted on the column on the inner peripheral side, and on the column on the outer peripheral side, and these are arranged to be aligned alternately on the circumference with substantially equal intervals. The LED chips are LED chips which radiate a blue light. Phosphor is mixed into the transparent resin, and yellow phosphor which radiates a yellow light in a relationship of a complementary color with the blue light is mainly used in order to be able to output white-based light such as a neutral white color and the incandescent-lamp color.

For the light emitting elements 22 which are mounted on the middle column, light emitting elements 22R, 22G, and 22B which respectively emit light of red, green, and blue are used. Accordingly, the LED chips are LED chips which respectively emit light of red, green, and blue, and these LED chips are sealed by the transparent resin for molding.

These light emitting elements 22R, 22G, and 22B which respectively emit light of red, green, and blue are continuously arranged on the circumference in order of red, green, and blue with substantially equal intervals. The light emitting elements 22R, 22G, and 22B may not necessarily be arranged on the same circumference on the substrate 21. That is, the light emitting elements may be continuously arranged on the circumference of difference radius with substantially equal intervals.

In addition, the arrangement of the light emitting elements 22R, 22G, and 22B may be a random order without being specified, and for example, may be arranged in order of light emitting elements 22B, 22R, and 22G. In addition, it is preferable to arrange light emitting elements 22 of different color from each other for light emitting elements which are adjacent to each other, however, it is not limited particularly. As an example, it is also possible to continuously arrange two light emitting elements of the same color such as the light emitting elements 22R and 22R, 22G and 22G and 22B and 22B.

In this manner, the plurality of light emitting elements 22N and 22L are arranged by forming columns on the circumference of the approximately concentric circle of different radius, and the plurality of light emitting elements 22R, 22G, and 22B are arranged by forming columns on the circumference the center of which is approximately the same as that of the circle, and between the columns of the light emitting elements of 22N and 22L.

Accordingly, since the plurality of light emitting elements 22 the luminous colors of which are different, that is, the light emitting elements of 22N, 22L, 22R, 22G, and 22B are arranged, the range of light colors to be expressed is wide due to the light mixing of these, and it is possible to appropriately perform toning of the light colors by adjusting the output of the light emitting element 22.

In addition, as shown in FIG. 4 mainly, an auxiliary light source, for example, the light emitting element 22*a* for night light is mounted on the same substrate as that of the light emitting element 22 which configures the light source unit 2, on the specified substrate 21*a* (on the upper right in FIG. 4). The light emitting element 22*a* is arranged on the inner circumferential side of the light emitting element 22 which configures the light source unit 2, and a light emitting element of the same specification as that of the light emitting element 22L which configures the light source unit 2 which is mounted in a circle shape is used.

In addition, a remote control signal light reception unit (signal input unit) 25, and a channel setting switch 26 are mounted in the specified substrate 21*a*. The remote control signal light reception unit 25 is an infrared light-receiving element, is configured by a photodiode or the like as a photoelectric conversion element, receives an infrared light control signal which is transmitted from the remote control transmitter Rc, and is operated so as to control the light emitting state Of the light emitting element 22.

The channel setting switch 26 switches a channel of the remote control signal light reception unit 25 to be able to identify the lighting system when a plurality of lighting systems are provided in a range in which the signal transmitted from the remote control transmitter Rc can be transmitted. Accordingly, it is possible to control a specified lighting system by an operation of the remote control transmitter Rc, and to prevent the plurality of lighting systems from being operated at the same time, only when the setting of the switch 26 matches the setting of the channel setting switch which is provided at the remote control transmitter Rc.

In this manner, since the light emitting element 22*a* as the auxiliary light source, the remote control signal light reception unit 25, and the channel setting switch 26 are mounted on the same substrate as the substrate 21 on which the light emitting element 22 configuring the light source unit 2 is mounted, it is possible to omit the lead wire, or the like, or shorten the wiring length, thereby simplifying a relationship of wiring connection.

When it is assumed that the light emitting element 22*a* as the auxiliary light source, or the remote control signal light reception unit 25 are mounted on a separate substrate from the substrate 21 on which the light emitting element 22 configuring the light source unit 2 is mounted, it is necessary to configure the relationship of wiring connection using the lead wire or the like, and there is a possibility that the configuration becomes complicated.

In addition, since these light emitting element 22*a* as the auxiliary light source, the remote control signal light reception unit 25, and the channel setting switch 26 are arranged at the inner peripheral side of the light emitting element 22 configuring the light source unit 2, it is possible to form a compact mounting area, compared to a case where the above elements are arranged at the outer peripheral side.

Meanwhile, an optical sensor 6 to be described later is not mounted on the same substrate as the substrate 21 on which the light emitting element 22 configuring the light source unit 2 is mounted. The optical sensor 6 is configured by being mounted on a separate substrate. The optical sensor 6 has a function of automatically controlling the light emitting state of the light emitting element 22 by detecting the brightness therearound, however, in order to be able to provide two types of lighting systems of a lighting system including the function, and of a lighting system not including the function, the optical sensor is mounted on the separate substrate.

That is, when deploying a lighting system with no function of automatically controlling the light emitting state, it is possible to execute the system by omitting the optical sensor 6 easily.

In addition, the light emitting element 22*a* as the auxiliary light source can be separately dimmed from the light emitting element 22 configuring the light source unit 2. Accordingly, it is possible to light the light emitting element 22*a* as a night light by adjusting to the brightness which is desired by a user.

In addition, the LED may be mounted on the substrate 21 directly, or a cannon ball-type LED may be mounted, accordingly, a mounting method, or format is not particularly limited.

Figure 10:
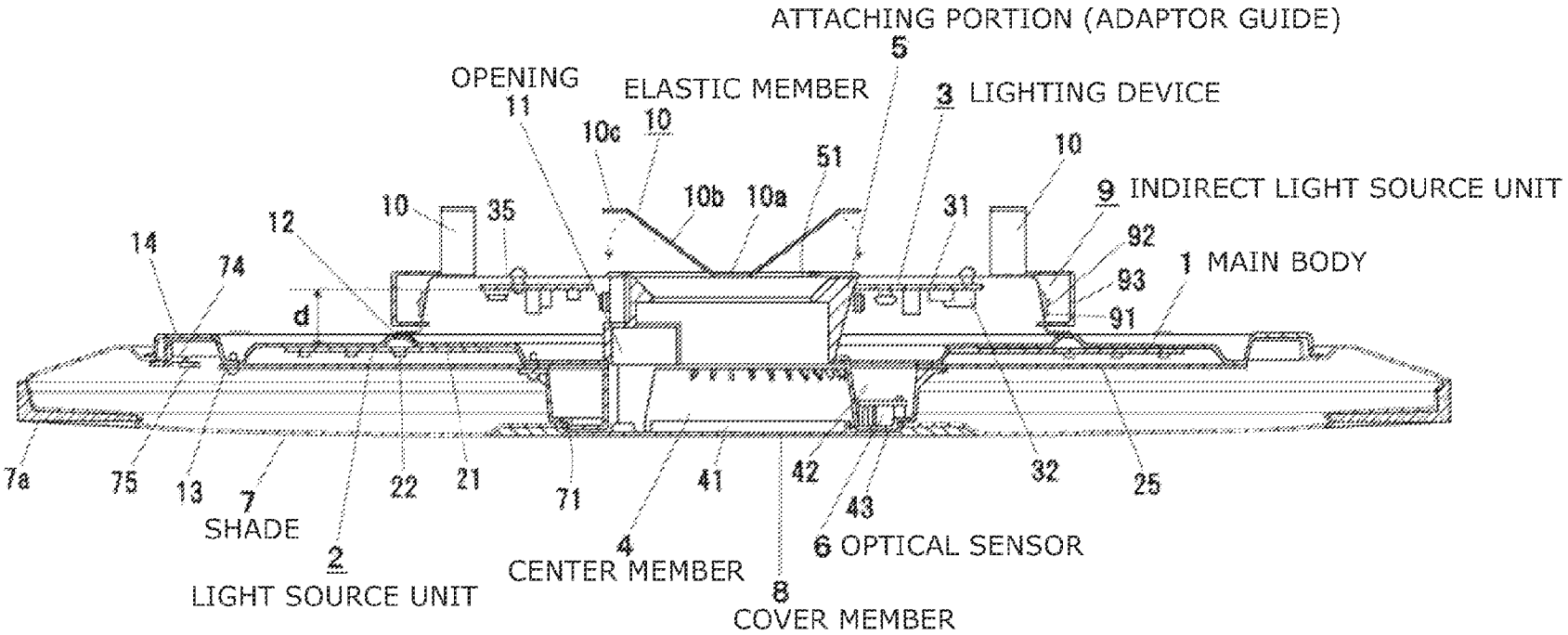
FIG. 10 is a vertical cross-sectional view of the lighting system.

As representatively shown in FIGS. 4, 10, and 12, in the light source unit 2 which is configured in this manner, the substrate 21 is located at the periphery of the opening 11 of the main body 1, and the mounting surface of the light emitting element 22 is arranged on the front surface side, that is, toward the irradiation direction on the lower side. In addition, the rear surface side of the substrate 21 is attached to the inner surface side of the main body 1 so as to come into close contact therewith, for example, using a fixing unit such as screw. Accordingly, the substrate 21 is thermally coupled to the main body 1, and heat from the substrate 21 is assumed to be radiated by being conducted to the main body 1 from the rear surface side of the substrate.

As shown in FIGS. 2, 10, and 12, a light source unit cover 25 is arranged on the front surface side of the light source unit 2. The light source unit cover 25 is formed of, for example, transparent synthetic resin with insulation properties such as polycarbonate, or acrylic resin, is integrally formed in an approximately circle shape along the arranged light emitting element 22, and is arranged so as to cover the entire surface of the substrate 21 including the light emitting element 22.

Accordingly, light which is output from the light emitting element 22 penetrates the light source unit cover 25. In addition, since the entire surface of the substrate 21 is covered by the cover, a charging unit is covered by the light source unit cover 25, and the insulation property thereof is secured.

As representatively shown in FIGS. 3, 10, 11, and 12, the lighting device 3 includes a circuit board 31, and circuit components 32 such as a transformer, a capacitor, a control IC (for example, a DSP (Digital Signal Processor), or an MPU (Micro-Processing Unit) which are mounted on the circuit board 31. The circuit board 31 is formed into a plate shape so as to surround the center portion, and is mounted with the circuit components 32 on the front surface side thereof.

The adaptor A is electrically connected to the circuit board 32, and a commercial AC power supply as an external power supply is connected to the circuit board through the adaptor A. Accordingly, the lighting device 3 generates a DC output by receiving the AC power supply, supplies the DC output to the light emitting element 22 through the lead wire, and controls lighting of the light emitting element 22.

In this manner, the lighting device 3 is arranged at the rear surface side of the main body 1 by being attached to, and covered by a lighting device cover 35. In this case, the circuit components 32 of the circuit board 31 are attached toward the front surface side (the lower side in figure).

The lighting device cover 35 is formed in a short cylindrical shape which is approximately rectangular using a metal material such as cold roll steel, a side wall 35*a* thereof is inclined toward the front surface side so as to be widened, and the center portion of a rear surface wall 35*b* is formed with an opening 35*c*.

As shown in FIGS. 3, 5, 10, and 12, a flange on the front surface side of the lighting device cover 35 is placed at a protrusion portion 12 of the chassis, and is attached by being screwed.

As shown in FIGS. 2, 4, 8, 10, and 12 as a reference, a center member 4 is formed of a synthetic resin material such as PBT resin, is formed in a shape of a short cylinder, and has an opening 41 which faces the ceiling hooking body Cb in the center portion. In addition, an annular space portion 42 is formed at the circumference of the opening 41, and an optical sensor 6 to be described later is arranged in the space portion 42.

In addition, a light reception window 43 which faces the light reception unit of the optical sensor 6, and a plurality of key-shaped engagement holes 44 are formed on the front surface wall of the center member 4. In addition, a plurality of engagement protrusions 45 protruding to the front surface side is formed at the edge of the outer periphery of the front surface wall. In addition, the light reception window 43 is formed at the front surface end of a guiding cylinder 46 of a cylinder shape which protrudes toward the inner side from the front surface wall (refer to FIGS. 13 and 14).

As shown in FIG. 12 mainly, in the center member 4 configured in this manner, the flange on the rear surface side thereof is attached to the chassis through the light source unit cover 25 by being screwed. In addition, the center member 4 can be attached to the chassis directly, or indirectly, and the specific attachment configuration is not limited.

Figure 3:
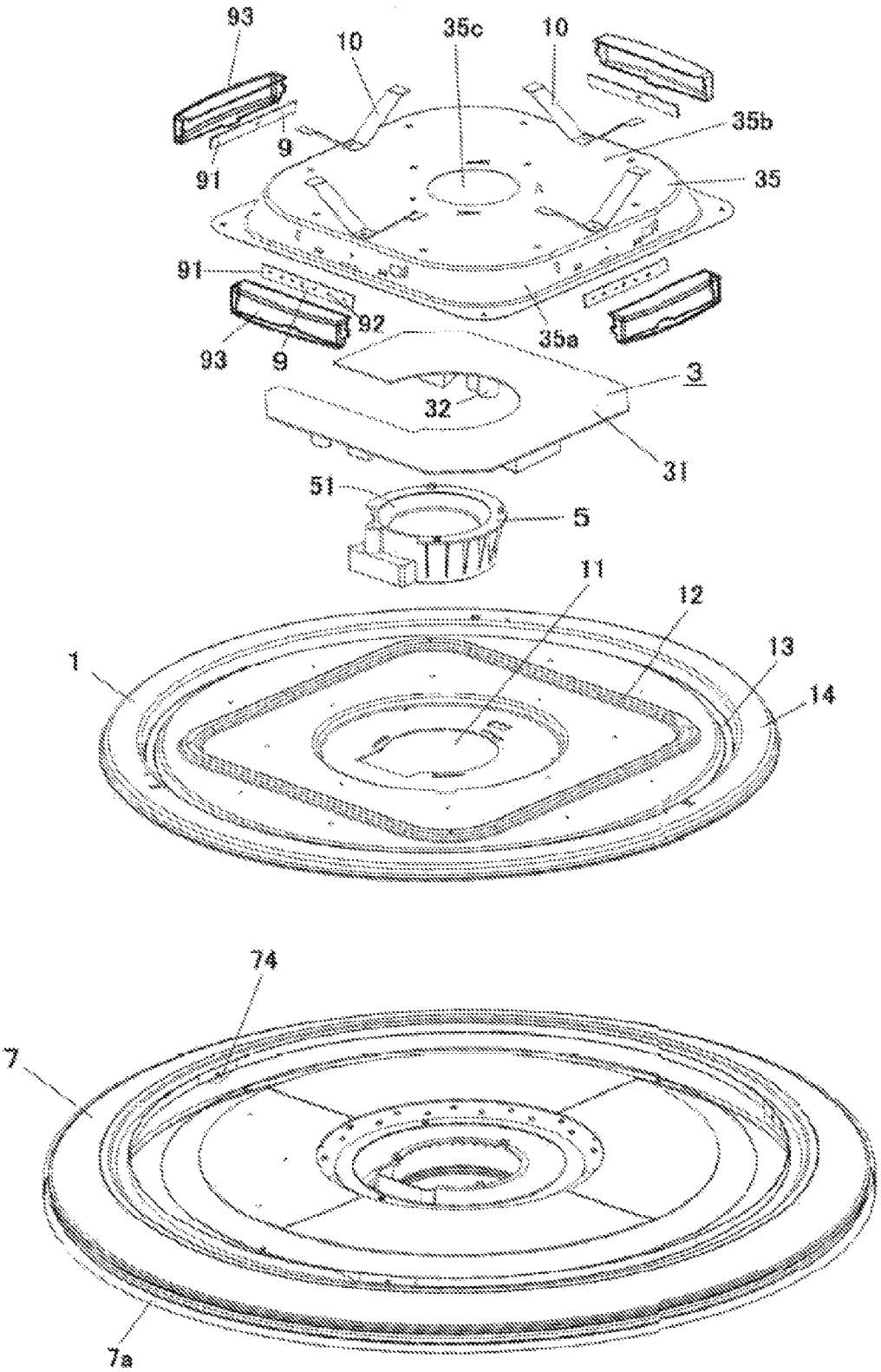
FIG. 3 is an exploded perspective view which shows the rear surface side of the lighting system.

An adaptor guide 5 is a member to and with which the adaptor A is inserted and engaged. As shown in FIGS. 3, 10, and 12, the adaptor guide 5 is formed an approximately cylinder shape, the adaptor A is inserted through the center portion thereof, and an engagement port 51 for engaging is provided. The adaptor guide 5 is arranged corresponding to an opening 11 which is formed at the center portion of the main body 1.

Figure 14:
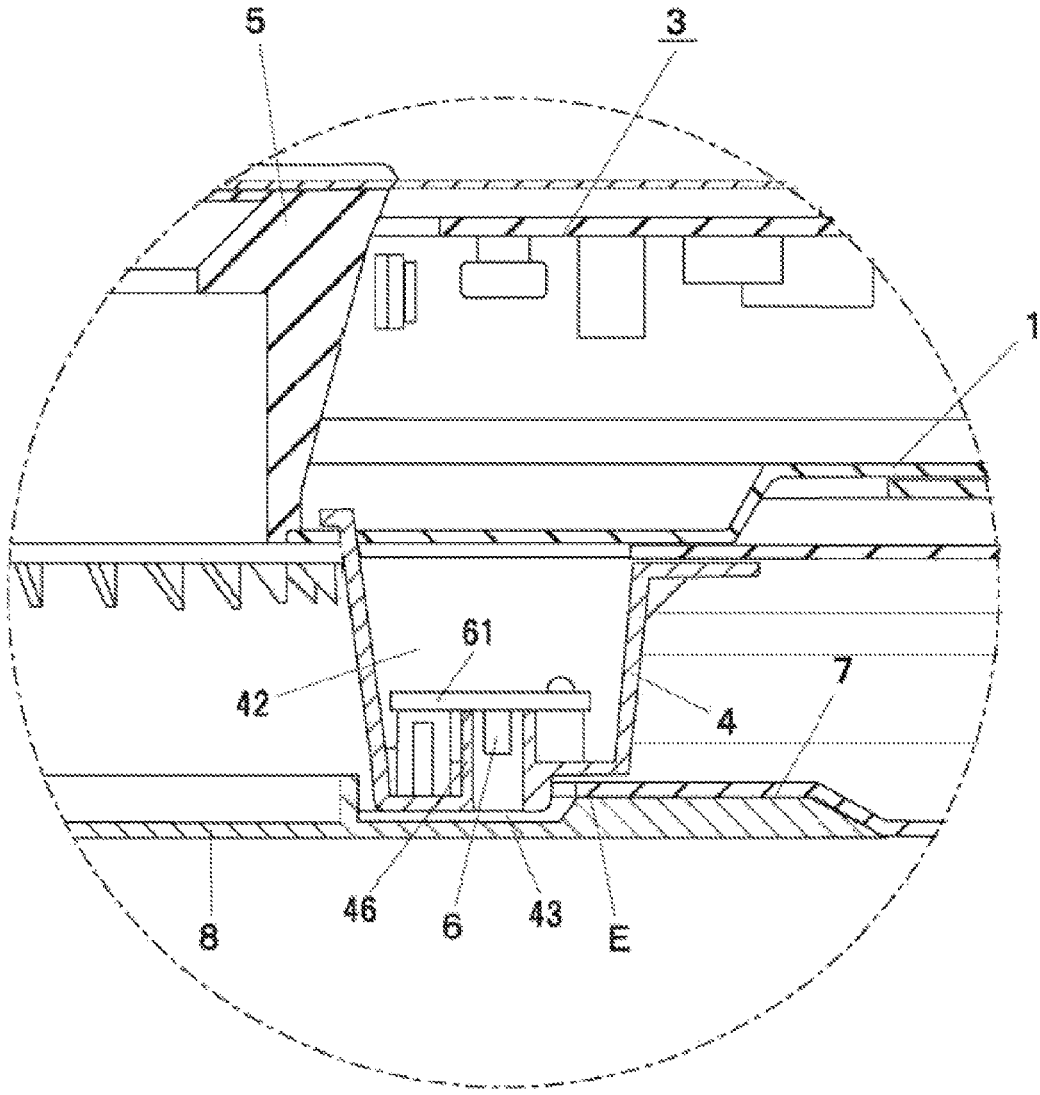
FIG. 14 an enlarged cross-sectional view which shows the portion B in FIG. 12, and a state where the cover member is attached.
Figure 15:
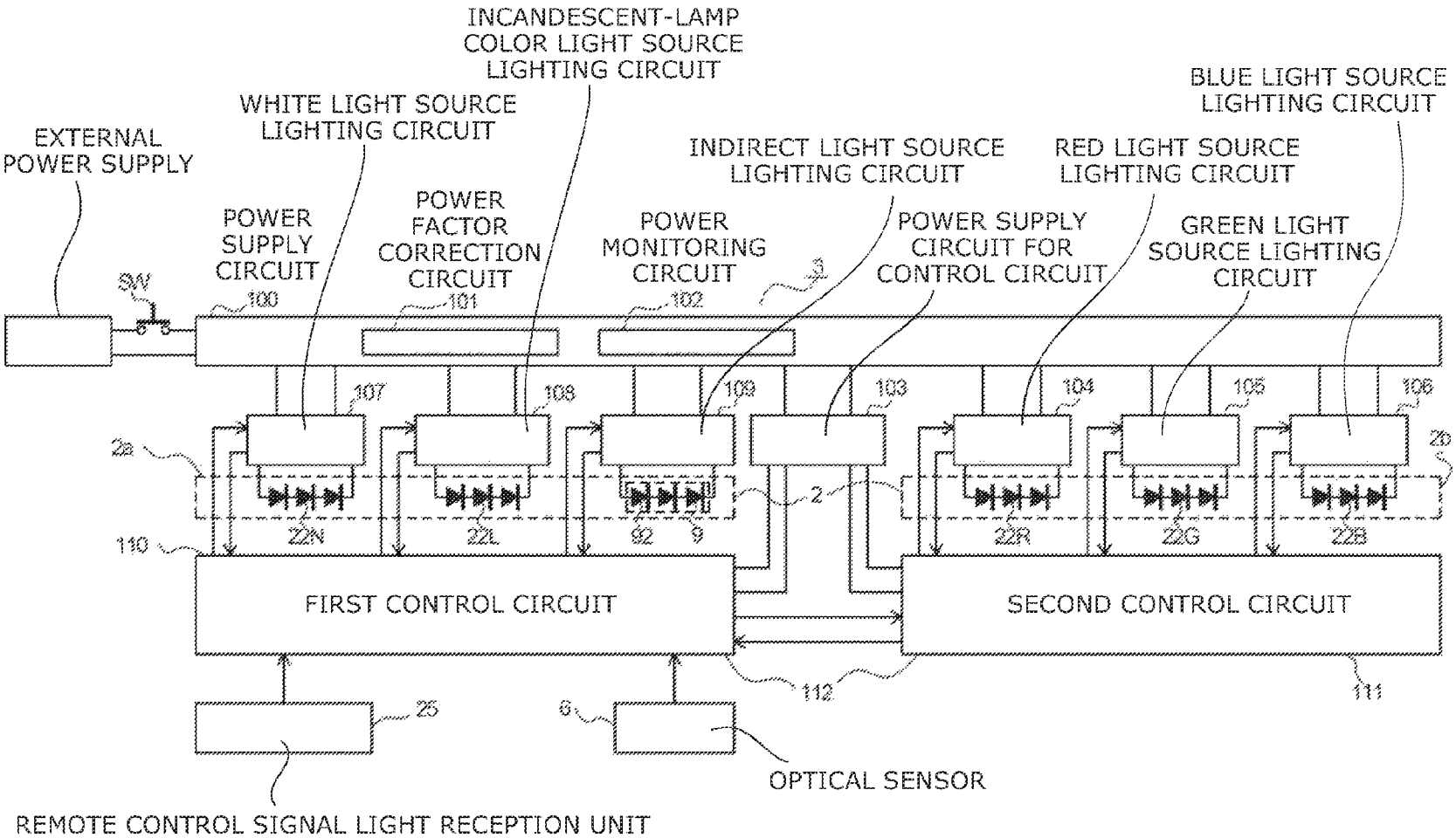
FIG. 15 is a configuration diagram which shows a circuit configuration of the lighting device of the lighting system.

As shown in FIGS. 14 and 15, the optical sensor 6 is an illuminance sensor, is formed of a sensor element such as a photodiode, and is operated so as to output a detection signal by detecting the brightness therearound. In this manner, when the circumference is bright, the light source unit 2, that is, the light emitting element 22 is controlled to light by performing dimming.

The optical sensor 6 is mounted on the substrate 61, and the light reception unit thereof is arranged in the space portion 42 of the center member 4 so as to face the light reception window 43, and is attached thereto. More specifically, the substrate 61 is screwed to a boss of the center member 4, the optical sensor 6 is accommodated in the guide cylinder 46, and the light reception unit thereof is arranged so as to face the light reception window 43.

The shade 7 is formed into an approximately cylinder shape, of a transparent material such as acrylic resin, and of a milky white diffusional material, and a circular opening 71 is formed at the center portion thereof. In addition, a clock decorative rim 7*a* is attached to the outer periphery of the shade 7, and the clock decorative rim 7*a* is formed using a transparent material which is formed of acrylic resin, or the like.

In addition, the shade 7 is detachably attached to the outer periphery edge of the main body 1 so as to cover the front surface side of the main body 1 including the light source unit 2. Specifically, the shade 7 is attached by engaging a shade mounting bracket 74 which is provided at the shade 7 to the shade receiving metal fitting 75 which is provided at the concave portion formed by the protrusion unit 14 of the main body 1, by being rotated.

In addition, when the shade 7 is detached, it is possible to detach the shade 7 by rotating it in the direction opposite to the direction during attachment, and by releasing the engagement between the shade mounting bracket 74 and the shade receiving metal fitting 75.

As shown in FIGS. 2, 7, 9, 10, and 12, a cover member 8 is formed in a cylindrical shape, of a material such as transparent acrylic resin. The cover member 8 corresponds to the opening 71 of the shade 7, is attached to the front surface wall of the center member 4, and is arranged so as to cover and close the opening 41 of the center member 4.

A circular transparent portion 81 facing the light reception window 43 of the optical sensor 6 is formed in the cover member 8, and the rear surface side thereof is formed with a plurality of L-shaped engagement protrusions 82 facing the plurality of key-shaped engagement holes 44 which is formed on the front surface wall of the center member 4.

In addition, on the front surface side of the cover member 8, it is preferable to adhere a non-transmissive film material by at least remaining the transparent portion 81.

An indirect light source unit 9 is provided on the rear surface side of the main body 1, and has a function of mainly illuminating the ceiling surface brightly. As shown in FIGS. 3, 5, 10, and 12, the indirect light source unit 9 includes a substrate 91, and a plurality of light emitting element 92 which is mounted on the substrate 91.

The substrate 91 on which the light emitting element 92 is mounted is attached to four places on a side wall 35*a* of the lighting device cover 35. In addition, the substrate 91 is covered by a box-shaped translucent cover 93.

The light emitting element 92 is an LED similarly to the light source unit 2, and a surface mount-type LED package. In addition, the light emitting element 92 performs a lighting control by being connected to the lighting device 3. Further, as a luminous color, it is possible to use a neutral white color, a daylight color, an incandescent-lamp color, a red color, a green color, or blue color, or a combination of these colors.

In addition, it is preferable to direct the substrate 91 obliquely upward, however, for example, the substrate may be directed in the vertical direction, or in the horizontal direction. When the substrate is directed in the vertical direction, light output from the light emitting element 92 is mainly radiated in the horizontal direction, however, a part of light is radiated to the ceiling surface due to a spread of a light distribution range. In addition, when the substrate is directed in the horizontal direction, the light output from the light emitting element 92 is mainly radiated in the vertical direction, and is radiated to the ceiling surface.

In addition, when the indirect light source unit 9 is arranged on the rear surface side of the main body 1, the indirect light source unit is not necessarily attached to the lighting device cover 35, and may be attached to other members or portions.

When the light emitting element 22 is used as the light source in the light source unit 2 in this manner, since the light which is output from the light emitting element 22 has strong directivity, the light distribution range thereof becomes narrow, however, it is possible to improve the brightness of the space by providing the indirect light source unit 9 on the rear surface side of the main body 1 as in the embodiment. Accordingly, it is effective to provide the indirect light source unit 9, when the light source of the light source unit 2 is set to the light emitting element 22. In addition, the lighting states of the light source unit 2 and the indirect light source unit 9 are controlled by the optical sensor 6 which outputs a detection signal by detecting the brightness therearound.

Elastic members 10 are attached to the vicinity of the plurality of indirect light source units 9 corresponding to each of attaching positions of the indirect light source units 9. The elastic member 10 is a member which is arranged so as to be interposed between the ceiling surface C and the lighting system in a state where the lighting system is attached to the ceiling surface C as the unit attaching surface (refer to FIG. 12).

Specifically, the elastic member 10 is a metal spring member which is formed of a material such as stainless steel, and is attached to the rear surface side of the lighting device cover 35 corresponding to the attaching position of each of the indirect light source units 9. The elastic member 10 is formed by bending a rectangular leaf spring which is laterally long, has a fixing portion 10*a* in the center portion, is formed with an extending portion 10*b* which is widened toward obliquely upward (rear surface side) from both sides of the fixing portion 10*a*, and a rectangular abutting portion 10*c* is formed at the tip end side thereof.

In addition, a screw through hole is formed in the fixing portion 10*a*, and the elastic member 10 is fixed to the rear surface side of the lighting device cover 35 by penetrating the screw through hole, and by a fixing screw which is screwed to the rear surface side of the lighting device cover 35.

In this manner, as the elastic member 10, members with the same shapes in four members, and with the same elastic forces are used.

As representatively shown in FIG. 10, in the fixed state of the elastic member 10, the elastic member 10 which is arranged on the rear surface side of the lighting device cover is elastically deformable in the front surface side direction (arrow direction in the figure) having the fixing portion 10*a* as a fulcrum along with a spring action. In addition, as mainly shown in FIG. 6, the extended direction of the extending portion 10*b*, in other words, the elastic member 10 is arranged so that both the elastic member 10 and the indirect light source unit 9 are arranged in parallel by being matched in the longitudinal direction each other. Accordingly, it is possible to prevent the elastic member 10 from acting as an obstacle of the light which is output from the indirect light source unit 9.

In addition, the abutting portion 10*c* may be provided with a non-slip unit such as sponge, or silicone rubber by bonding or the like. The abutting portion 10*c* is a portion which comes into close contact with the ceiling surface C directly, or indirectly.

In addition, the elastic member 10 may be a member which is arranged so as to be elastically interposed between the ceiling surface C and the lighting system in a state where the lighting system is attached to the ceiling surface C as the unit attaching surface, and for example, it is possible to use an elastically deformable material such as sponge, or silicone rubber. However, when considering a thermal durability, it is preferable to use a material such as metal, or silicone rubber.

As shown in FIG. 12, the adaptor A is electrically and mechanically connected to the ceiling hooking body Cb which is provided at the ceiling surface C using a hook blade which is provided on the top face side, has an approximately cylindrical shape, and a pair of locking unit A1 is provided so as to protrude toward the outer periphery side at all times using a built-in spring, on both sides of the peripheral wall. The locking unit A1 is embedded by operating a lever which is provided at the lower surface side. In addition, a power code which is connected to the lighting device 3 is derived from the adaptor A, and is connected to the lighting device 3 through a connector.

Figure 11:
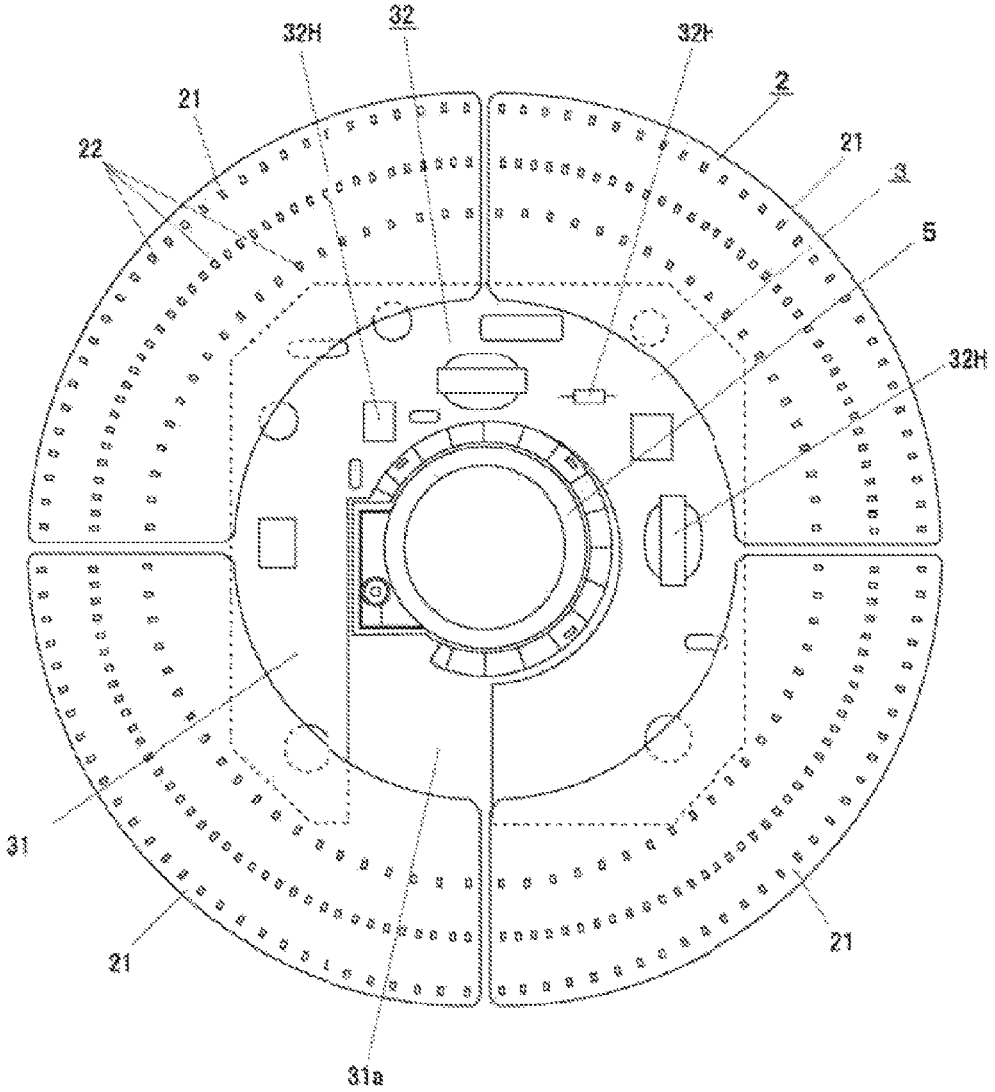
FIG. 11 is a plan view which shows a positional relationship between the light source unit and the lighting device.

An arrangement relationship between the light source unit 2 and the lighting device 3 will be described with reference to FIGS. 4, 10, and 11. In addition, FIG. 11 is an explanatory diagram which shows the positional relationship between the light source unit 2 and the lighting device 3 in a plane.

The light source unit 2 is configured by mounting a plurality of light emitting elements 22 on the circumference of the approximately circle-shaped substrate 21. In addition, the rear surface side of the substrate 21 is thermally coupled to the main body 1, and is attached thereto. Accordingly, the plurality of light emitting elements 22 are arranged at the periphery of the mounting portion 5, and specifically, as mainly shown in FIGS. 4 and 11, the light emitting elements are arranged so as to surround the mounting portion 5 when seen in a planar manner.

On the other hand, as shown in FIG. 10, the lighting device 3 is arranged at the rear surface side of the main body 1, and is attached to the lighting device cover 35 by being apart from the light source unit 2 by a separation distance d in the rear surface direction. In addition, the circuit components 32 are arranged so as to surround the periphery of the mounting portion 5 which inserts through a notch portion 31*a* of the circuit board 31, and as shown in FIG. 11, are located in the plurality of light emitting elements 22 which are aligned on the circumference.

In addition, among the circuit components 32, a heat-generating component 32H a heat generation amount of which is relatively large is arranged in the vicinity of the mounting portion 5.

Accordingly, the light emitting element 22 in the light source unit 2, and the circuit components 32 in the lighting device 3 are located by being apart from each other by a separation distance d in the rear surface direction, and the circuit components 32 are located in the light emitting element 22. That is, the light emitting element 22, and the circuit components 32 are arranged by being deviated in both the vertical direction (anterodorsal direction) and the horizontal direction (radius direction). In addition, the heat-generating component 32H among the circuit components 32 is arranged by being apart from the light emitting element 22.

For this reason, the light emitting element 22 and the circuit components 32 are arranged so as to be thermally separated from each other, accordingly, it is possible to suppress the mutual thermal interference of heat which is generated from the light emitting element 22 and the circuit components 32.

In addition, since the light emitting element 22 and the circuit components 32 are arranged at the periphery about the mounting portion 5, it is possible to realize a compact configuration. Further, since the lighting device 3 is arranged on the rear surface side of the main body 1, it is possible to secure a predetermined light distribution range without narrowing the range of light which is output from the light source unit 2.

Figure 7:
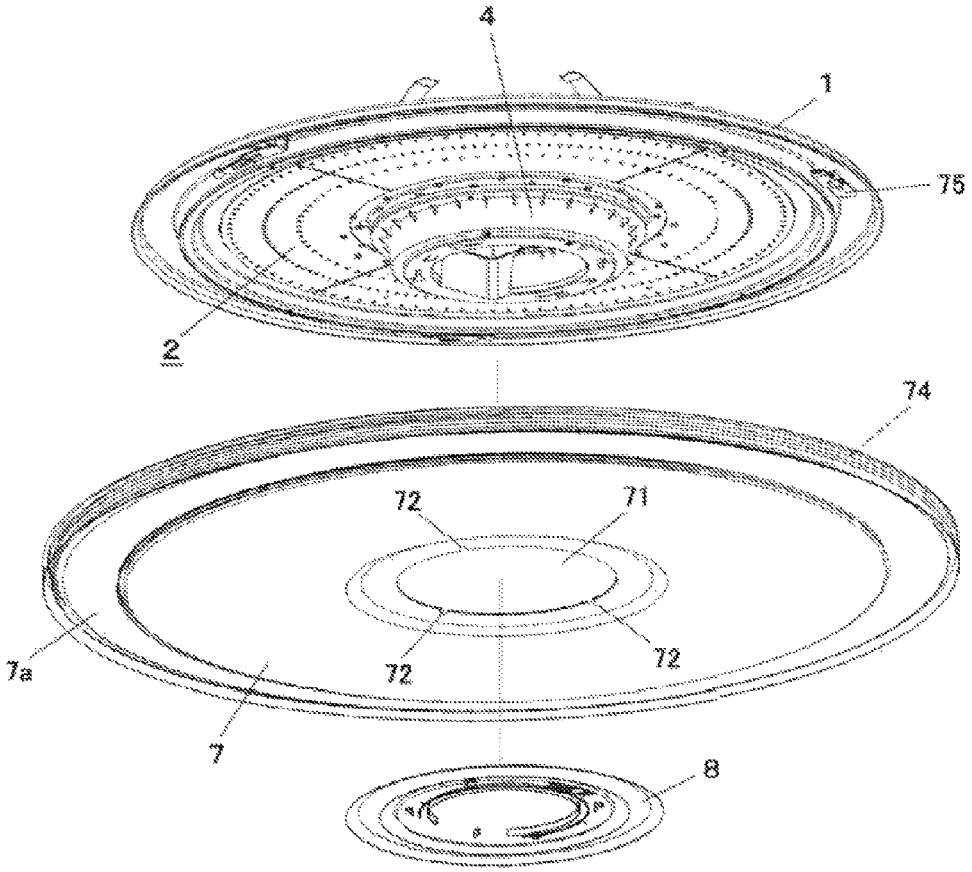
FIG. 7 is a perspective view which shows the lighting system in a state where the shade and a cover member are been detached.
Figure 8:
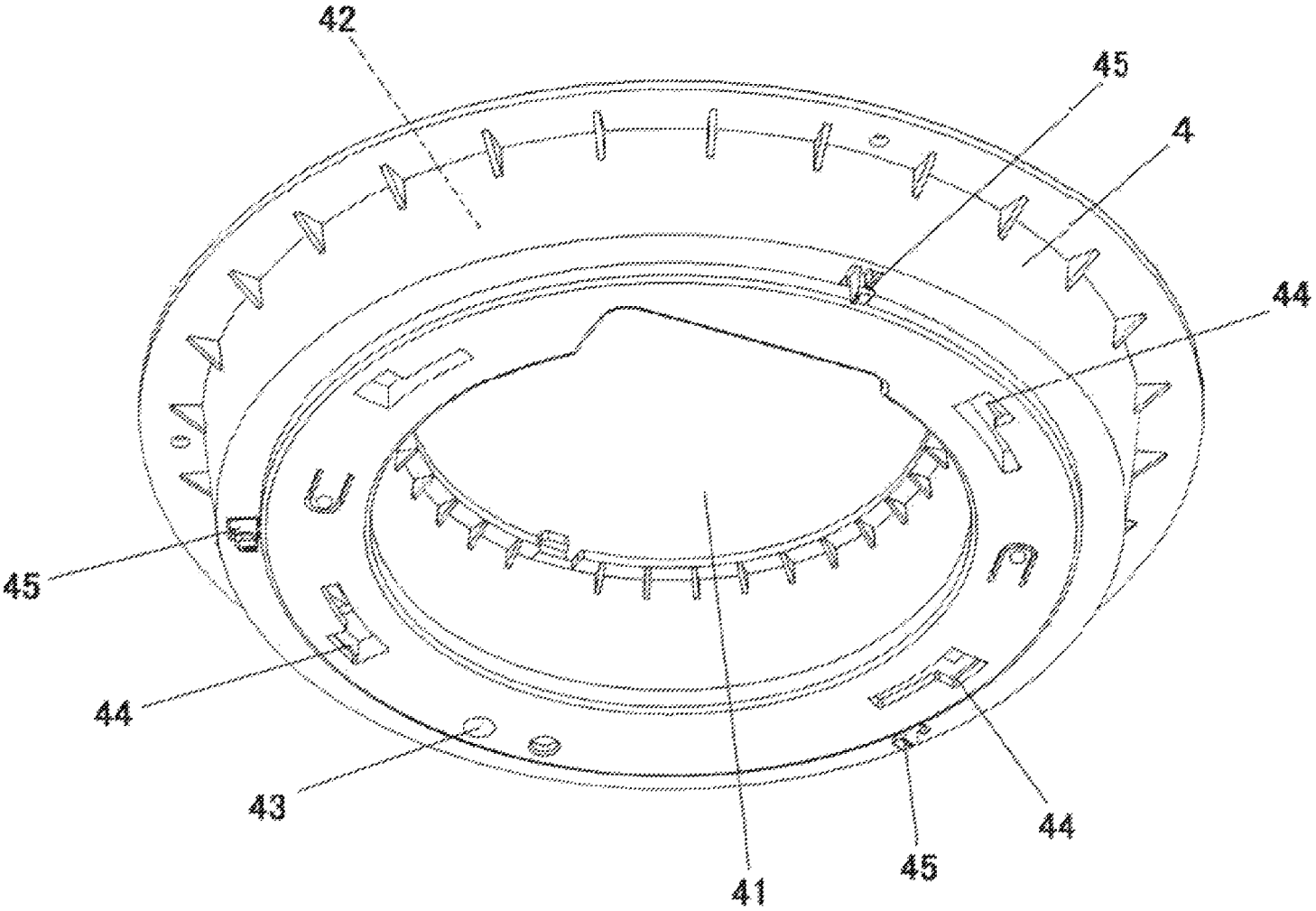
FIG. 8 is a perspective view which shows a center member of the lighting system.
Figure 9:
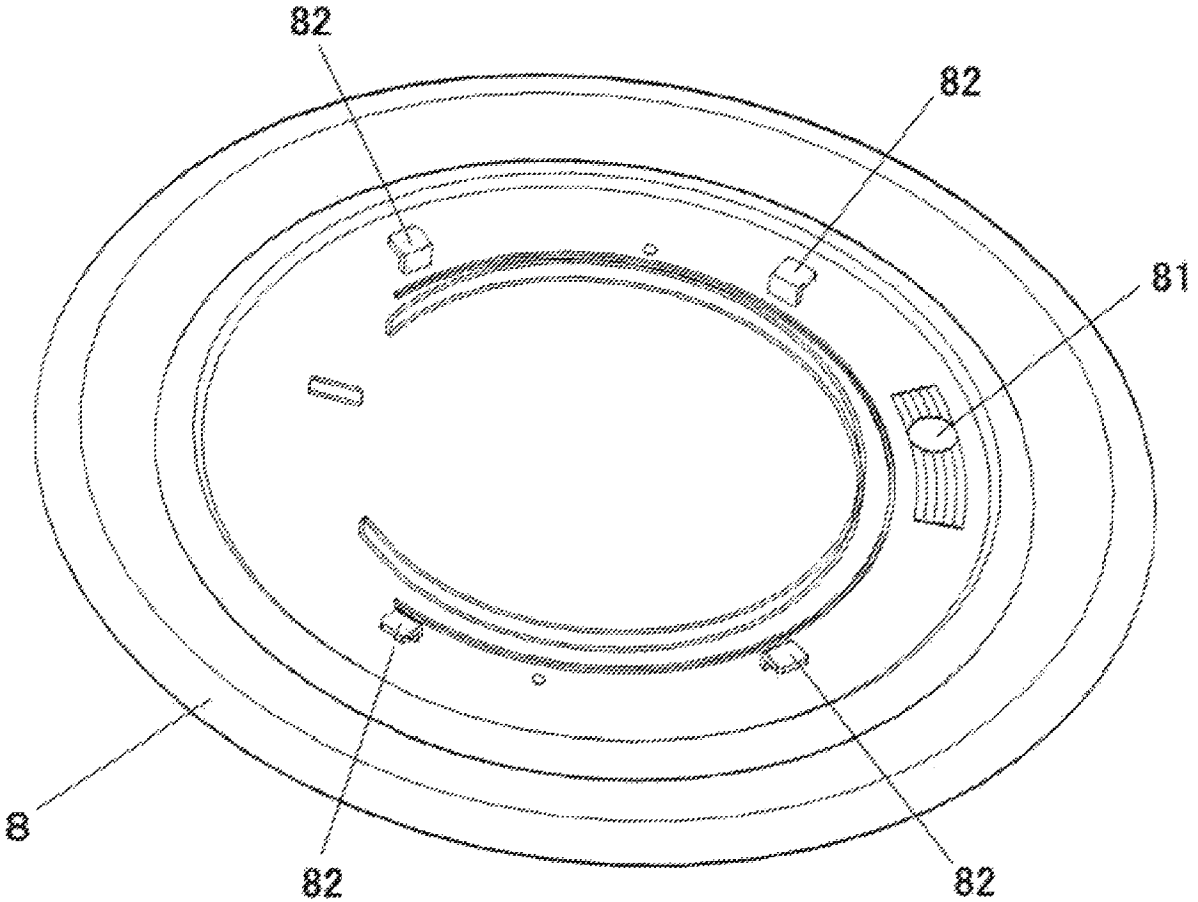
FIG. 9 is a perspective view which shows the rear surface side of the cover member of the lighting system.

Subsequently, attaching processing of the shade 7 will be described with reference to FIGS. 6 to 9. First, as shown in FIG. 7, the shade 7 is attached to the main body 1. This processing can be performed by rotating the outer peripheral edge of the shade 7 conforming to the outer peripheral edge of the main body 1, and by engaging the shade mounting bracket 74 which is provided at the shade 7, and the shade receiving metal fitting 75 which is provided at the main body 1 with each other.

A positional relationship between an opening edge portion E of the shade 7 and the light reception window 43 of the optical sensor 6 which is formed in the center member 4 will be described with reference to FIGS. 13 and 14.

Figure 13:
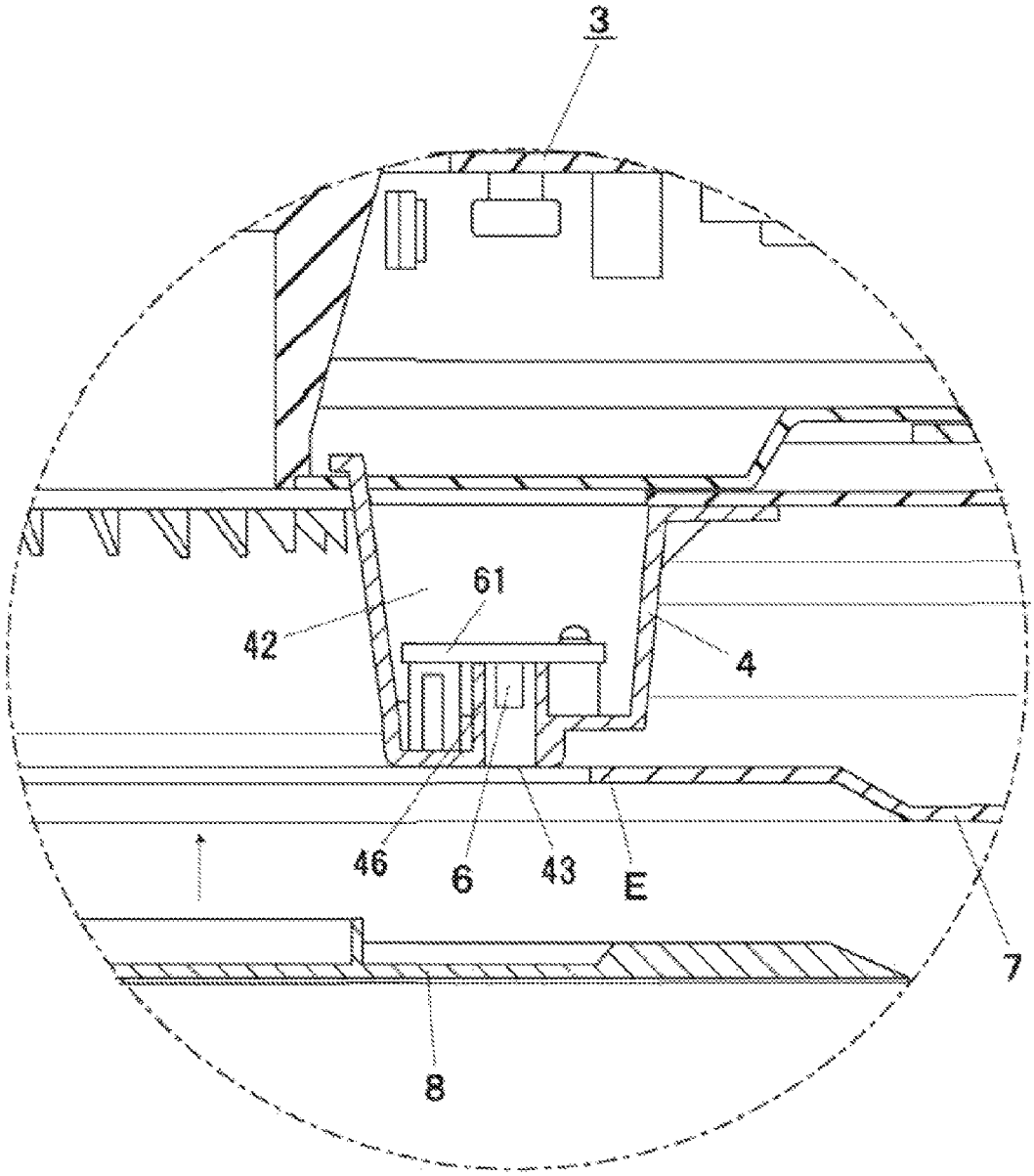
FIG. 13 is an enlarged cross-sectional view which shows a portion B in FIG. 12, and a state where the cover member is not yet attached.

As shown in FIG. 13, in a state where the shade 7 is attached to the main body 1, that is, in a state where the cover member 8 is not attached yet, the opening edge portion E of the shade 7 is located in front of the front surface of the center member 4, and is located in front of the light reception window 43 of the optical sensor 6.

As shown in FIG. 14, when the cover member 8 is attached in this state, the opening edge portion E of the shade 7 is located at the rear side of the front surface of the center member 4. Specifically, the opening edge portion E of the shade 7 is located at the rear side of the light reception window 43 of the optical sensor 6.

As shown in FIG. 13, when it is assumed that the opening edge portion E of the shade 7 is located in front of the light reception window 43 of the optical sensor 6, there is a possibility that the light which is output from the light source unit 2, and is diffused, or guided by the shade 7 is input from the light reception window 43, and has an effect on the optical sensor 6.

However, as shown in FIG. 14, it is possible to prevent the light from the light source unit 2 from influencing the optical sensor 6, by causing the opening edge portion E of the shade 7 to be located at the rear side of the front surface of the center member 4, and at the rear side of the light reception window 43 of the optical sensor 6.

Subsequently, the attaching state of the lighting system to the ceiling surface C will be described with reference to FIG. 12. First, the adaptor A is electrically and mechanically connected to the ceiling hooking body Cb which is provided at the ceiling surface C in advance. In a state of detaching the cover member 8 of the lighting system, the attaching operation is performed in which the system main body 1 is attached by being pushed up by hands from below against an elastic force of a spring member for attaching lighting system 10 until the locking unit A1 of the adaptor A is reliably engaged with the engagement port 51 of the adaptor guide, while fitting the engagement port 51 of the adaptor guide to the adaptor A.

Subsequently, the cover member 8 is attached, and the opening 41 at the center portion of the center member 4 facing the ceiling hooking body Cb is covered and closed.

In this state, the elastic member 10 is elastically deformed, and the abutting portion 10*c* elastically comes into close contact with the ceiling surface C. In addition, the abutting portion 10*c* is able to come into close contact with the ceiling surface C approximately parallel in a planar manner, or so that the tip end portion faces a little bit in the vertical direction.

Accordingly, the elastic member 10 is interposed between the rear surface side of the lighting device cover 35 as the rear surface side of the system main body 1 and the ceiling surface C by being elastically deformed in the compression direction, and the main body 1 of the lighting system is in a state of being reliably held and attached to the ceiling surface C due to the spring action of the elastic member 10.

When the lighting device 3 is supplied with electric power in a state where the lighting system is attached to the ceiling surface C, the light emitting element 22 is electrified through the substrate 21 in the light source unit 2, and each of the light emitting elements 22 is lighted. The light which is output to the front surface side from the light emitting element 22 penetrates the light source cover 25, is diffused by the shade 7, penetrates the shade, and is radiated to the outside. Accordingly, the lower part is illuminated in a predetermined light distribution range.

Subsequently, a circuit configuration and an operation of the lighting device 3 of the lighting system according to an example 1 will be described.

Figure 16:
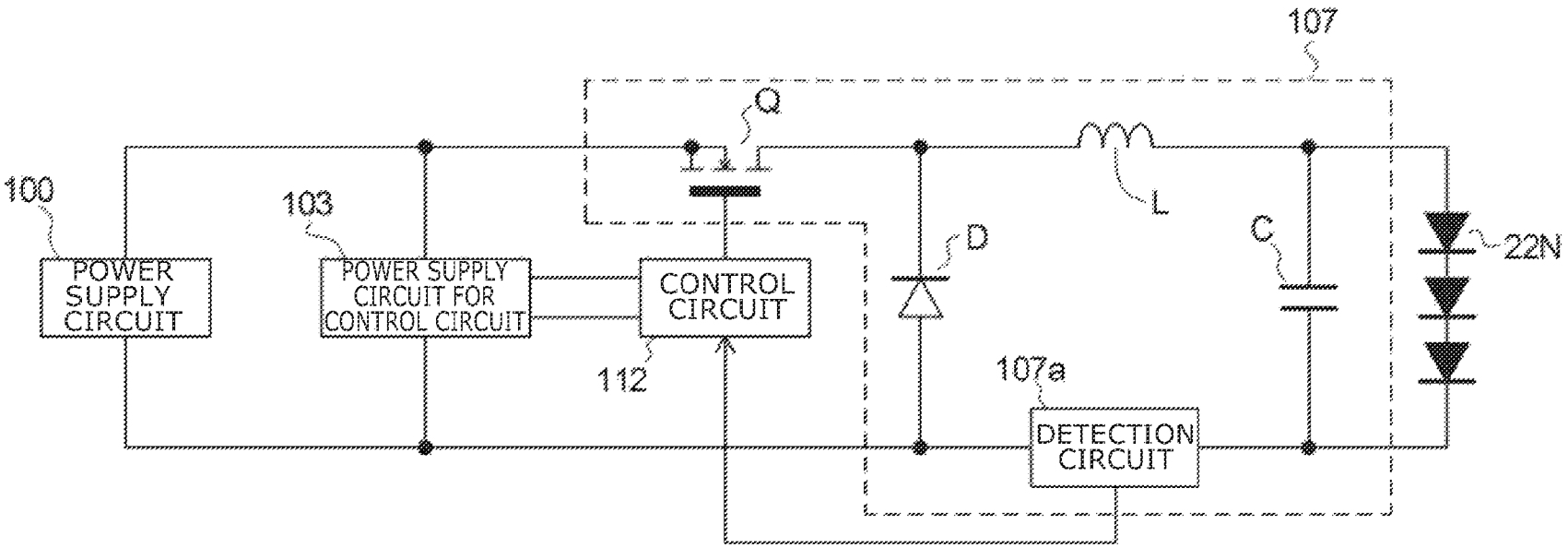
FIG. 16 is a circuit diagram of a white light source lighting circuit of the lighting device of the lighting system.

The circuit configuration of the lighting device 3 of the lighting system according to the example 1 will be described with reference to drawings. FIG. 15 is a configuration diagram which shows a circuit configuration of a lighting device 3 of a lighting system according to the example 1, and FIG. 16 is a circuit diagram of a white light source lighting circuit 107 of the example 1. In addition, the same portions are given the same reference numerals, and repeated descriptions will be omitted.

The lighting device 3 according to the example 1 includes a power supply circuit 100, a red light source lighting circuit 104, a green light source lighting circuit 105, a blue light source lighting circuit 106, a white light source lighting circuit 107, an incandescent-lamp color light source lighting circuit 108, an indirect light source lighting circuit 109, an optical sensor 6, a remote control signal light reception unit 25, a first control circuit 110 as a control circuit 12, and a second control circuit 111. In addition, in FIG. 15, descriptions of a light emitting element 22*a* as an auxiliary light source, and a lighting circuit for performing a lighting control of the light emitting element 22*a* are omitted.

The power supply circuit 100 is connected to an external power supply through a switch SW, and converts an AC power supply to a DC power supply when the external power supply is the AC power supply. More specifically, the switch SW is a wall light switch or the like which is provided on the wall or the like of a building. The power supply circuit 100 has a general circuit configuration including a smoothing capacitor which is connected to a rectifier using a diode, and to the output side of the rectifier in parallel with respect to the rectifier. In addition, the power supply circuit 100 includes a power factor correction circuit 101 and a power monitoring circuit 102, and the power factor correction circuit 101 has a general circuit configuration. The power monitoring circuit 102 monitors a power supply state to the power supply circuit 100 from the external power supply. More specifically, the ON or OFF state of the switch SW, and a switching time to the ON state from the OFF state are detected. The power monitoring circuit 102 sends a detection result to the control circuit 112 to be described later.

The power supply circuit 100 is connected with a power supply circuit for control circuit 103, the red light source lighting circuit 104, the green light source lighting circuit 105, the blue light source lighting circuit 106, the white light source lighting circuit 107, the incandescent-lamp color light source lighting circuit 108, and the indirect light source lighting circuit 109, respectively. The power supply circuit for control circuit 103, the red light source lighting circuit 104, the green light source lighting circuit 105, the blue light source lighting circuit 106, the white light source lighting circuit 107, the incandescent-lamp color light source lighting circuit 108, and the indirect light source lighting circuit 109 are supplied with the DC power from the power supply circuit 100, respectively.

The power supply circuit for control circuit 103 supplies power to first and second control circuits 110 and 111 as a control circuit 112 to be described later.

The light emitting element 22R for emitting red light in which a peak wavelength is 620 to 640 nm, and the half-value width is 10 to 30 nm, for example, is connected to the red light source lighting circuit 104. The light emitting element 22R is lighted by the red light source lighting circuit 104.

The light emitting element 22G for emitting green light in which a peak wavelength is 510 to 530 nm, and the half-value width is 40 to 60 nm, for example, is connected to the green light source lighting circuit 105. The light emitting element 22G is lighted by the green light source lighting circuit 105.

The light emitting element 22B for emitting blue light in which a peak wavelength is 440 to 470 nm, and the half-value width is 10 to 30 nm, for example, is connected to the blue light source lighting circuit 106. The light emitting element 22B is lighted by the blue light source lighting circuit 106.

The light emitting element 22N for emitting white light in which a peak wavelength is 500 to 600 nm, and the half-value width is 100 to 200 nm, for example, is connected to the white light source lighting circuit 107 by being excited by blue light in which a correlated color temperature is approximately 4600 to 7100 K, a peak wavelength is 440 to 470 nm, and the half-value width is 10 to 30 nm, for example. The light emitting element 22N is lighted by the white light source lighting circuit 107.

The light emitting element 22L for emitting incandescent-lamp color light in which a peak wavelength is 550 to 650 nm, and the half-value width is 100 to 200 nm, for example, is connected to the incandescent-lamp color light source lighting circuit 108 by being excited by blue light in which a correlated color temperature is approximately 2500 to 3200 K, a peak wavelength is 440 to 470 nm, and the half-value width is 10 to 30 nm, for example. The light emitting element 22L is lighted by the incandescent-lamp color light source lighting circuit 108.

The light emitting element 92 for emitting incandescent-lamp color light in which a peak wavelength is 550 to 650 nm, and the half-value width is 100 to 200 nm, for example, is connected to the indirect light source lighting circuit 109 by being excited by blue light in which a correlated color temperature is approximately 2500 to 3200 K, a peak wavelength is 440 to 470 nm, and the half-value width is 10 to 30 nm, for example. The light emitting element 92 is lighted by the indirect light source lighting circuit 109.

The color temperature of the light emitting elements 22R, 22G, 22B, 22N, 22L, and 92 may be obtained by a signal light source, or may be obtained by performing additive light mixing of a plurality of light sources the color temperatures of which are different. When obtaining a predetermined color temperature using a plurality of light sources, either a combination of the same types, or a combination of different types is possible. In addition, since the number of light emitting elements 22R, 22G, 22B, 22N, 22L, and 92 is not specially limited, it is possible to appropriately use one, or plural elements, arbitrarily. In addition, the number of respective light emitting elements 22R, 22G, 22B, 22N, 22L, and 92 may be the same, or not. In addition, in the embodiment which is shown, a plurality of LEDs with the same color temperature is used by being connected in series, for example.

In addition, the light emitting elements 22N, 22L, and 92 configure the first light source unit 2*a*, and the light emitting elements 22R, 22G, and 22B configure the second light source unit 2*b*. Accordingly, the light source unit 2 is configured by the first light source unit 2*a* and the second light source unit 2*b*.

The specific circuit system of the red light source lighting circuit 104, the green light source lighting circuit 105, the blue light source lighting circuit 106, the white light source lighting circuit 107, the incandescent-lamp color light source lighting circuit 108, and the indirect light source lighting circuit 109 is not specially limited, and it is possible to adopt an appropriate circuit corresponding to the type of a light source. According to the example, since the light emitting elements 22 and 92 are used in the light source unit 2, it is possible to adopt a DC lighting system for the red light source lighting circuit 104, the green light source lighting circuit 105, the blue light source lighting circuit 106, the white light source lighting circuit 107, the incandescent-lamp color light source lighting circuit 108, and the indirect light source lighting circuit 109, and more specifically, it is possible to adopt a DC-DC converter, for example, a circuit configuration for performing constant current control of step-down chopper. By adopting this circuit configuration, it has advantages that it is possible to raise a circuit efficiency, and to perform a control easily.

For example, when the white light source lighting circuit 107 in FIG. 15 is exemplified, in the circuit configuration in which the step-down chopper is subject to constant current control, as shown in FIG. 16, a switching element Q, an inductor L, and a series circuit of an output capacitor C are connected between the output terminals of the power supply circuit 100, and accumulates an electromagnetic energy in the inductor L by flowing an increasing current which increases linearly from the power supply circuit 100 when the switching element Q is turned on. In addition, a closed circuit is formed by connecting the diode D and the portion of the output capacitor C which is connected in series, to the inductor L in parallel, and a decreasing current which linearly decreases flows to the closed circuit from the inductor L when the switching element Q is turned off. The step-down DC voltage is output to both ends of the output capacitor C by repeating accumulating and flowing of the electromagnetic energy to the above described inductor L. The light emitting elements 22N are connected in parallel to both ends of the output capacitor C as the output terminal of the step-down chopper.

A detection circuit 107*a* is inserted in series to a portion of the white light source lighting circuit 107 to which the increasing current which flows to the switching element Q, the inductor L, and the series circuit of the output capacitor C, and the decreasing current of the inductor L, the output capacitor C, and the closed circuit of the diode D flow together, and the current value is detected. In addition, the detection circuit 107*a* is configured so as to be able to detect the terminal voltage of the output capacitor C. A detection value of the detection circuit 107*a* is input to the control circuit 112, and the control circuit 112 controls the switching element Q on the basis of the detection value which is input from the detection circuit 107*a*. In addition, the control circuit 112 is supplied with the power from the power supply circuit for controlling circuit 103.

The control circuit 112 performs a dimming control of the light source unit 2 on the basis of a signal which is transmitted from the remote control signal light reception unit 25 to be described later, or the optical sensor 6. In addition, it is possible to change light source color of the light source unit 2, that is, it is possible to perform the toning control by changing the ratio of the optical output of the light emitting element 22 with different luminous color in the light source unit 2. In addition, when performing dimming control and toning control, it is possible to perform the dimming control, or toning control in which it is possible to give an impression as if the brightness, or the light source color is almost continuously changed, including any of a dimming control or a toning control in which the brightness, or the light source color is continuously changed, and a dimming control, or a toning control in which a step change is performed. In addition, it is possible to set the control circuit 112 to be able to change the color temperature of the light source color of the light source unit 2 to a desired value, or to select a change by stopping the change, when a desired light color is obtained by continuously changing the color temperature of the light source color of the light source unit 2 on the basis of the signal from the remote controller transmitter Rc. Further, the control circuit 112 may perform the dimming control, or the toning control by synchronizing each of the lighting circuits, or by non-synchronizing thereof.

In addition, the white light source lighting circuit 107 is configured so as to perform a dimming operation using a continuous current subject to an amplitude control, and a PWM current which is subject to a PWM control. In addition, according to the example, when it is the amplitude control, the control is performed using a current value detected by the detection circuit 107*a*, and when it is the PWM control, the control is performed using the current value detected by the detection circuit 107*a*, as well.

In addition, for the red light source lighting circuit 104, the green light source lighting circuit 105, the blue light source lighting circuit 106, the incandescent-lamp color light source lighting circuit 108, and the indirect light source lighting circuit 109, it is possible to adopt the same configuration as that of the white light source lighting circuit 107, as well, as shown in FIG. 16.

The control circuit 112 is operated by being supplied with the power from the power supply circuit for controlling circuit 103. The control circuit 112 includes the first and second control circuits 110 and 111. The first control circuit 110 respectively controls the white light source lighting circuit 107, the incandescent-lamp color light source lighting circuit 108, and the indirect light source lighting circuit 109 by transmitting a control signal thereto, on the basis of a current value which flows to the light emitting elements 22N, 22L, and 92, and a voltage value to be applied which are detected by the white light source lighting circuit 107, the incandescent-lamp color light source lighting circuit 108, and the indirect light source lighting circuit 109. In addition, the first control circuit 110 is connected to be able to receive the signal from the remote control signal light reception unit 25 and the optical sensor 6. The remote control signal light reception unit 25 receives a signal which is transmitted by operating the remote control transmitter Rc, and transmits a signal based on the reception signal to the first control circuit 110. As a medium for performing a communication between the remote control transmitter Rc and the remote control signal light reception unit 25, infrared light is used in the example 1, however, it is also possible to use a variety of medium which is known such as a radio wave, and wired communication is also used. In addition, the optical sensor 6 detects illuminance of a space in which the lighting system is provided, and transmits a signal based on a detection value to the first control circuit 110.

In addition, similarly to the first control circuit 110, the second control circuit 111 performs a respective lighting control for the red light source lighting circuit 104, the green light source lighting circuit 105, the blue light source lighting circuit 106 by transmitting a control signal thereto, on the basis of a current value which flows to the light emitting elements 22R, 22G, and 22B, and a voltage value to be applied which are detected by the red light source lighting circuit 104, the green light source lighting circuit 105, the blue light source lighting circuit 106.

It is possible to perform a desired lighting control of the light source unit 2, by operating the remote control transmitter Rc, or the switch SW which is provided on the wall face. In the remote control transmitter Rc, it is possible to arrange for example, a maximum light output switch, a light output increasing switch, a light output decreasing switch, an off-switch, and a color temperature increasing switch and a color temperature decreasing switch of the light source color of the first light source unit 2*a* by the light emitting elements 22N and 22L for performing the lighting control of the light source unit 2.

Figure 17A:
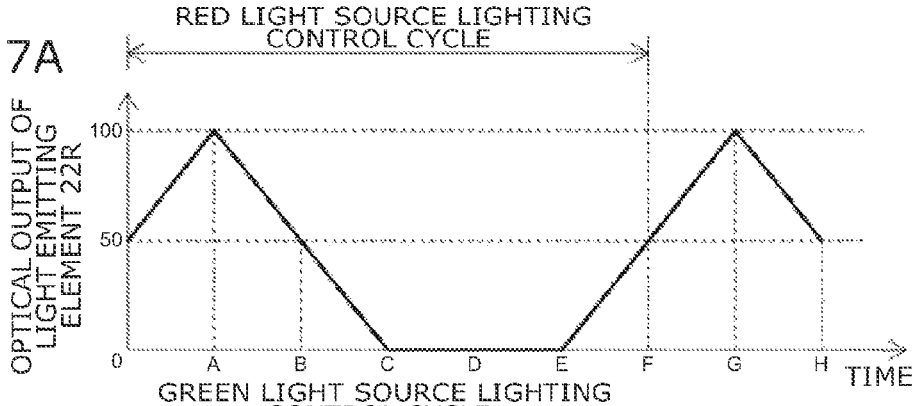
FIGS. 17A to 17C are explanatory diagrams of a light source lighting control cycle of a control circuit of the lighting device of the lighting system.
Figure 17B:
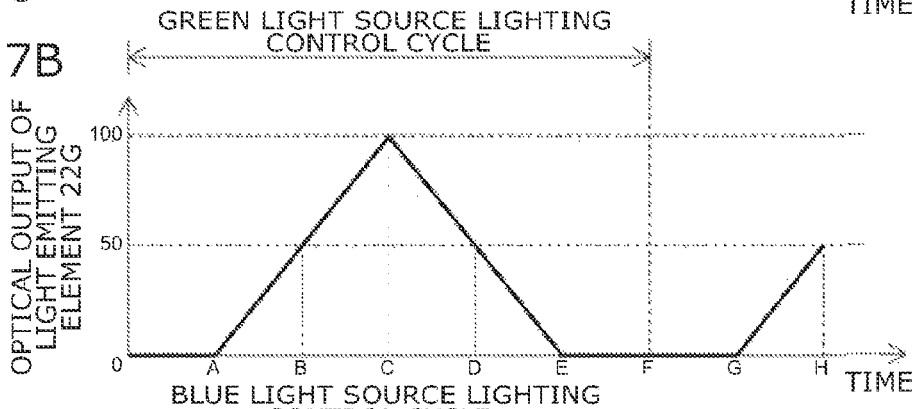
Figure 17C:
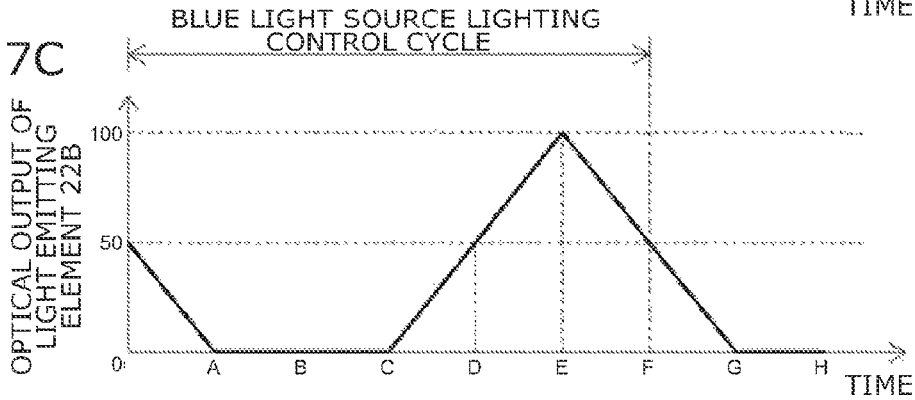

The operation of the lighting device 3 of the lighting system according to the example 1 will be described with reference to FIGS. 15 to 17C. FIGS. 17A to 17C are explanatory diagrams of a light source lighting control cycle of the control circuit 112 of the lighting device 3 of the lighting, system. In addition, the same portions are given the same reference numerals, and repeated descriptions will be omitted.

The light source lighting control cycle will be described with reference to FIGS. 17A to 17C. In FIGS. 17A to 17C, the vertical axis is an optical output of the light emitting element 22, and the horizontal axis is an elapsed time from the start of the light source lighting control cycle. In addition, the vertical axis may be a current value which flows to the light emitting element 22, or is a voltage value which is applied thereto, in addition to the optical output. The light source lighting control cycle includes a control of increasing of the optical output, a control of decreasing of the optical output, and a constant control of the optical output of the light emitting element 22. In addition, the constant control of the optical output includes an OFF state (0% of optical output) of the light emitting element 22.

Regarding the light source lighting control cycle, a red light source lighting control cycle which is shown in FIG. 17A will be exemplified for descriptions. The red light source lighting control cycle performs a lighting control of a red light source lighting circuit 104 so that the optical output of the light emitting element 22R becomes 50% when a control is started on the basis of a first signal (corresponding to the elapsed time 0 in FIG. 17A). The red light source lighting control cycle performs the lighting control of the red light source lighting circuit 104 so that the optical output of the light emitting element 22R becomes 100% from 50% from the start of the control until the time of point A in the figure. The red light source lighting control cycle performs the lighting control of the red light source lighting circuit 104 so that the optical output of the light emitting element 22R becomes 0% from 100% from the elapsed time of point A until the point C in the figure. The red light source lighting control cycle performs the lighting control of the red light source lighting circuit 104 so that the optical output of the light emitting element 22R becomes 0% from the elapsed time of point C until the point E in the figure. The red light source lighting control cycle performs the lighting control of the red light source lighting circuit 104 so that the optical output of the light emitting element 22R becomes 50% from 0% from the elapsed time of point E until the point F in the figure. The light source lighting control cycle is for performing the series of lighting control, and the data is stored in the second control circuit 111, or the control circuit 112. When a signal based on the first signal is input to the control circuit 112, the control circuit 112 continuously instructs the light source lighting circuit to perform the lighting control based on the light source lighting control cycle until the first signal, the second signal, or the dimming signal is input, and the light emitting element 22 is continuously subject to the lighting control by the light source lighting circuit. In addition, when the first signal is input again after starting the lighting control based on the light source lighting control cycle, the control circuit 112 may return to the lighting control before inputting the first signal (for example, maximum light output).

Subsequently, the operation of the control circuit 112 by the light source lighting control cycle will be described.

When the remote control signal reception unit 25 receives the first signal which is transmitted from the remote control transmitter Rc, the first control circuit 110 transmits a signal based on the first signal to the second control circuit 111. When receiving a signal based on the first signal, the second control circuit 111 controls the lighting circuit on the basis of the light source lighting control cycle, and performs the lighting control of the light emitting element 22. More specifically, when receiving a signal based on the first signal, the second control circuit 111 controls the red light source lighting circuit 104 based on the red light source lighting control cycle shown in FIG. 17A, and performs the lighting control of the light emitting element 22R. Similarly, when receiving a signal based on the first signal, the second control circuit 111 controls the green light source lighting circuit 105 based on the green light source lighting control cycle shown in FIG. 17B, and performs the lighting control of the light emitting element 22G. Similarly, when receiving a signal based on the first signal, the second control circuit 111 controls the blue light source lighting circuit 106 based on the blue light source lighting control cycle shown in FIG. 17C, and performs the lighting control of the light emitting element 22B.

When the remote control signal reception unit 25 receives the second signal which is transmitted from the remote control transmitter Rc, the first control circuit 110 transmits a signal based on the second signal to the second control circuit 111. When receiving a signal based on the first signal, the second control circuit 111 starts a control of the light source lighting circuit, and the lighting control of the light emitting element 22 based on the light source lighting control cycle, and repeatedly continues the control of the light source lighting circuit based on the light source lighting control cycle, and the lighting control of the light emitting element 22 until a single based on the second signal is input to the second control circuit 111. When a signal based on the second signal is input to the second control circuit 111, the control of the light source lighting circuit based on the light source lighting control cycle, and the lighting control of the light emitting element 22 are stopped. For example, in FIG. 17A, when a signal based on the second signal is input to the second control circuit 111 at a time of point D in the figure, the red light source lighting circuit 104 continues the lighting control of the light emitting element 22R with the optical output of 0%. In addition, similarly, in FIG. 17B, the green light source lighting circuit 105 continues the lighting control of the light emitting element 22G with the optical output of 50%. Similarly, in FIG. 17C, the blue light source lighting circuit 106 continues the lighting control of the light emitting element 22B with the optical output of 50%.

When a signal based on the second signal is input to the second control circuit 111, and when a signal based on a dimming signal is input to the second control circuit 111 after stopping a control of the light source lighting circuit based on the light source lighting control cycle, and the lighting control of the light emitting element 22, the second control circuit increases or decreases the respective optical output of the light emitting elements 22R, 22G, and 22B, while maintaining the ratio of the respective optical output of the light emitting elements 22R, 22G, and 22B. In addition, "a signal based on the dimming signal is input to the second control circuit 111" means that a dimming signal which is transmitted from the remote control transmitter Rc is received in the remote control signal reception unit 25, and a signal based on the dimming signal from the first control circuit 110 is transmitted to the second control circuit 111.

A case where the light source lighting control cycle is stopped at a time point D shown in FIGS. 17A to 17C will be exemplified for descriptions. When a signal based on the first and second signals is input to the second control circuit 111, and when a dimming signal based on the operation of the optical output decreasing switch of the remote control transmitter Rc is input to the second control circuit 111 after stopping a control of the light source lighting circuit based on the light source lighting control cycle, and the lighting control of the light emitting element 22, the second control circuit 111 decreases the respective optical output of the light emitting elements 22R, 22G, and 22B, while maintaining the ratio of the respective optical output of the light emitting elements 22R, 22G, and 22B, accordingly, the light emitting element 22R is subject to the lighting control so as to have the optical output of 0%, and the light emitting elements 22G and 22B are subject to the lighting control so as to have the optical output of 25% from 50%. That is, the dimming control is performed while maintaining the color temperature of the light source color which is output from the second light source unit 2*a* at the time of stopping the light source lighting control cycle.

The control circuit 112 stores a control target value of the light source lighting control cycle when stopping the light source lighting control cycle based on a predetermined signal from the remote control transmitter Rc. "A control target value of the light source lighting control cycle" is data itself of the light source lighting control cycle which is stored in the control circuit 112 in advance in order for the control circuit 112 to control the light source lighting circuit. In addition, the data stored in the control circuit 112 may be the optical value of the light emitting element 22, a current value which flows to the light emitting element 22, or a voltage value to be applied.

The control circuit 112 controls the light source lighting circuit on the basis of the stored data, and performs the lighting control of the light emitting element 22 by receiving a third signal which is sent from the remote control transmitter Rc.

In addition, according to the example, all of the first, second, and third signals, or any two of the signals may be the same signals. If it is possible to perform the lighting control of the light emitting element 22 based on the start and end of the light source lighting control cycle, and the control target value of the light source lighting control cycle which is stored in the control circuit 112, the signal which is input to the remote control signal reception unit 25, or the control circuit 112 may be any signal.

According to the example, a case where the light emitting elements 22R, 22G, and 22B are subject to the lighting control is shown, however, the light source lighting control cycle for performing the lighting control of the light emitting elements 22N and 22L may be provided, or when the light emitting elements 22R, 22G, and 22B are subject to the lighting control by the light source lighting control cycle, the light emitting elements may be turned off or lighted using an optical output of lower limit in a range of capable of controlling the light emitting elements 22N and 22L.

In addition, according to the example, the first signal is a signal for starting the light source lighting control cycle which is sent from the remote control transmitter Rc in order to instruct the control circuit 112 to start the light source lighting control cycle, and the second signal is a signal for stopping the light source lighting control cycle which is sent from the remote control transmitter Rc in order to instruct the control circuit 112 to stop the light source lighting control cycle.

Effects of the lighting system according to the example 1 are shown below.

In the lighting device 3 of the lighting system according to the example 1, since the control circuit 112 includes the light source lighting control cycle, it is not necessary to perform toning by performing the dimming of the light emitting elements 22R, 22G, and 22B, respectively, and it is possible to set the color temperature of the light source unit 2 to a desired state by performing a simple operation of starting and stopping the light source lighting control cycle from the remote control transmitter.

In the lighting device 3 of the lighting system according to the example 1, since the control circuit 112 includes the light source lighting control cycle, it is possible to set the color temperature of the light source unit 2 to a desired state by performing a simple operation of starting and stopping the light source lighting control cycle from a general remote control transmitter, without performing toning by a special instrument using a chromaticity coordinate.

In the lighting device 3 of the lighting system according to the example 1, the control target value of the light source lighting control cycle when the light source lighting control cycle of the control circuit 112 is stopped is stored in a storage unit of the control circuit 112, and it is possible to reset the color temperature of the light source unit 2 to a desired state by a simple operation of the remote control transmitter.

In the lighting system according to the example 1, the cover member 8 functions as a positioning member for positioning the opening edge portion E of the shade 7 at the rear side of the front surface of the center member 4, and positioning the opening edge portion E at the rear side of the light reception window 43 of the optical sensor 6. In addition, the positioning member for performing such a function is not limited to the cover member 8. It is also possible to position the opening edge portion E of the shade 7 at the rear side of the front surface of the center member 4, and the opening edge portion E at the rear side of the light reception window 43 of the optical sensor 6 using another configuration, or another member.

In the lighting system according to the example 1, when the indirect light source unit 9 is electrified, each light emitting element 92 is lighted, and the light output obliquely upward from the light emitting element 92 penetrates the translucent cover 93, and is mainly radiated to the ceiling surface. Accordingly, the ceiling surface becomes bright, and it is possible to improve the brightness. In this case, it is possible to stabilize light distribution properties of light which is radiated from the indirect light source unit 9, and to perform efficient indirect lighting.

In the lighting system according to the example 1, the lighting state of the light source unit 2 and the indirect light source unit 9 is controlled by the optical sensor 6 which outputs a detection signal by detecting the brightness therearound. In this case, since the opening edge portion E of the shade 7 is located at the rear side of the front surface of the center member 4, it is possible to prevent the light source unit 2 from influencing the optical sensor, and to perform an appropriate lighting control according to the brightness therearound.

In the lighting system according to the example 1, heat generated from the light emitting element 22 is effectively conducted to the main body 1, and is radiated in a large area, since the rear surface side of the substrate 21 is thermally coupled to the main body 1. In addition, since the main body 1 is formed with the protrusion units 12, 13, and 14, it is possible to increase the radiation surface area, and to further heighten the effect of radiation.

In addition, since the lighting device cover 35 is placed and attached to the protrusion unit 12 of the main body 1, the heat is conducted to the lighting device cover 35 from the main body 1, and the radiation is accelerated.

In the lighting system according to the example 1, the light emitting element 22 and the circuit components 32 are located by being apart from each other by a separation distance d in the rear surface direction, and the circuit components 32 are located in the light emitting element 22, and are arranged so as to be thermally separated, and the heat generated from the lighting device 3 is radiated mainly by a convection in a space in the lighting device cover 35, accordingly, it is possible to suppress the mutual thermal interference. Therefore, it is possible to suppress extreme increase in temperature of the light emitting element 22 and the circuit components 32. Further, since the heat-generating component 32H in the circuit components 32 is arranged far from the light emitting element 22, it is possible to further effectively suppress the mutual thermal interference.

In addition, in the lighting system according to the example 1, since the heat generated from the light emitting element 92 of the indirect light source unit 9 is conducted to a side wall 35*a* of the lighting device cover 35 from the rear surface side of the substrate 91, is conducted to the elastic member 10, as well, and is radiated, it is possible to provide a lighting system in which a mutual thermal interference between the light emitting element in the light source unit and the circuit components in the lighting device can be suppressed.

In the lighting system according to the example 1, it is possible to maintain the constant separation distance d between the ceiling surface C and each of the indirect light source units 9, and to maintain an output angle of light which is radiated from each of the indirect light source units 9. As a result, it is possible to stabilize the light distribution properties, and to perform indirect lighting by effectively radiating the ceiling surface C. In addition, since the elastic member 10 corresponds to each of the indirect light source units 9, and is arranged in the vicinity thereof, it is possible to expect a more effect in which the separation distance d between the ceiling surface C and each of the indirect light source units 9 becomes constant.

In addition, when detaching the lighting system, it is possible to detach the system by detaching the cover member 8, and by releasing the engagement of the locking unit Al of the adaptor A by operating a lever provided in the adaptor A through the opening 41 of the center member 4.

In the lighting system according to the example 1, it is possible to maintain the separation distance d between the ceiling surface C and each of the indirect light source units 9 constant, to stabilize the light distribution properties of the light which is radiated from the indirect light source unit 9, accordingly, it is possible to provide a lighting system in which a deviation of the light distribution properties can be reduced.

In the lighting system according to the example 1, the influence on the optical sensor 6 of the light source unit 2 can be suppressed, and it is possible to provide a lighting system in which lighting can be appropriately controlled according to the brightness therearound.

EXAMPLE 2

A lighting system according to an example 2a includes, a first light source which emits light the half-value width of which is 100 nm or more; a second light source which emits light the half-value width of which is less than 100 nm; a first lighting circuit which lights the first light source; a second lighting circuit which lights the second light source; an optical sensor; and a control circuit which performs a lighting control of the first lighting circuit based on a detection value of the optical sensor, and performs a lighting control of the second lighting circuit based on a value which is set in advance at the time of operating the optical sensor.

In the lighting system according to an example 2a, the control circuit of the lighting system of the example 2a is connected to the optical sensor, and includes a first control circuit which performs the lighting control of the first lighting circuit, and a second control circuit which performs the lighting control of the second lighting circuit.

Figure 18:
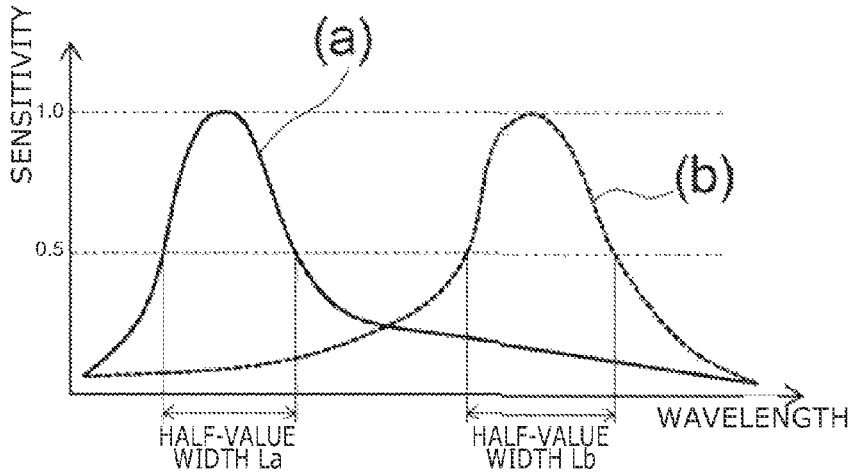
FIG. 18 is an explanatory diagram which shows the characteristics of an optical sensor of the lighting device of the lighting system according to a second example, and optical sensors of a lighting device of a lighting system according to a third example.

Operations of a lighting device 3 of the lighting system according to the example 2 (examples 2a or 2b) will be described with reference to FIGS. 15 to 18. FIG. 18 is an explanatory diagram which shows properties of an optical sensor 6 of the lighting device 3 of the lighting system according to the example 2. In addition, the same portions will be given the same reference numerals, and repeated descriptions will be omitted. The lighting system according to the example 2 has a structure shown in FIGS. 1 to 14, and has a circuit configuration of the lighting device 3 shown in FIGS. 15 and 16.

Properties of the optical sensor 6 of the lighting device 3 of the lighting system according to the example will be described with reference to FIG. 18. In FIG. 18, the vertical axis denotes a relative sensitivity of the optical sensor, the horizontal axis denotes a wavelength of light which is detected by the optical sensor. The curve (a) in FIG. 18 denotes a relationship between the sensitivity and the wavelength of the optical sensor 6. In addition, in the curve (a), the wavelength when the sensitivity of the optical sensor 6 becomes a peak may be determined using the half-value width La as shown in FIG. 18, for example. The wavelength when the sensitivity which is determined by the half-value width La becomes the peak is referred to as a peak wavelength, and the peak wavelength will be described as an example.

A light source of a lighting system in the related art was mainly white light in which light source color is approximately 4600 to 7100 K, and a peak wavelength is approximately 500 to 600 nm, indandescent-lamp color light in which light source color is approximately 2500 to 3200 K, and a peak wavelength is approximately 550 to 650 nm, and light which is subject to additive light mixing of these lights.

Since these lights have wavelengths different from the peak wavelength of the optical sensor 6, there was not a case of a misdetection of light which is output from the light source of the lighting system, by the optical sensor 6, even when illuminance or the like of a space which is lighted by a lighting system is detected, and the illuminance of the space which is lighted is constantly controlled (reducing an optical output of the lighting device when natural light such as sunlight is input to the lighted space).

On the other hand, in the lighting system of the example, since the light source unit 2 includes a light emitting element 22R for emitting red light, a light emitting element 22G for emitting green light, and a light emitting element 22B for emitting blue light, there is a case where a wavelength of the light of the light emitting element 22R, 22G, or 22B matches the peak wavelength.

Accordingly, in the lighting system according to the example, when there is a portion where the wavelength of any light of the light emitting element 22R, 22G, or 22B which is determined by the half-value width, and the wavelength when the sensitivity of the optical sensor 6 determined by the half-value width La becomes a peak match each other, or are overlapped with each other, the control circuit 112 controls a red light source lighting circuit 104, a green light source lighting circuit 105, and a blue light source lighting circuit 106 on the basis of predetermined values of the light emitting elements 22R, 22G, and 22B at the time of operation the optical sensor 6. In addition, "controlling the red light source lighting circuit 104, the green light source lighting circuit 105, and the blue light source lighting circuit 106 on the basis of the predetermined value" includes turning off the light emitting elements 22R, 22G, and 22B, or lighting thereof using a lower limit optical output in a controllable range.

In addition, "the half-value width of 100 nm or more" in the "first light source unit 2*a* which emits light half-value width of which is 100 nm or more" in the example means the respective half-value widths of the white light and the incandescent-lamp color light after being excited by the blue light of the light emitting elements 22N and 22L the half-value width of which is 10 to 30 nm, when the first light source unit 2*a* has at least the light emitting elements 22N and 22L.

The operations of the lighting device 3 of the lighting system in the example 2 will be described with reference to FIGS. 15 to 18.

A signal is sent from a remote control transmitter Rc when performing lighting control of the light source unit 2 on the basis of a detection value of the optical sensor 6, and when the signal which is sent from the remote control transmitter Rc is received by a remote control signal light reception unit 25, a first control circuit 110 of the control circuit 112 controls a white light source lighting circuit 107 and an incandescent-lamp color light source lighting circuit 108 according to the detection value of the optical sensor 6, and the light emitting elements 22N and 22L are subject to the lighting control by the white light source lighting circuit 107 and an incandescent-lamp color light source lighting circuit 108 according to the detection value of the optical sensor 6. That is, the control circuit 112 controls the white light source lighting circuit 107 and the incandescent-lamp color light source lighting circuit 108 so that a lighting space which is lighted by the lighting system has a predetermined brightness. When natural light such as sunlight is input to the lighting space, the optical sensor 6 detects an increase of the brightness of the lighting space, the control circuit 112 controls the white light source lighting circuit 107 and the incandescent-lamp color light source lighting circuit 108 on the basis of the detection value of the optical sensor 6, and reduces the optical output of the light emitting elements 22N and 22L. In addition, when an amount of the natural light input to the lighting space is reduced, and the brightness of the lighting space is decreased, the control circuit 112 controls the white light source lighting circuit 107 and the incandescent-lamp color light source lighting circuit 108 on the basis of the detection value of the optical sensor 6, and increases the optical output of the light emitting elements 22N and 22L so that the brightness of the lighting space becomes the predetermined brightness.

When a signal is sent from the remote control transmitter Rc so as to perform the lighting control of the light source unit 2 based on the detection value of the optical sensor 6, and the signal which is sent from the remote control transmitter Rc is received by the remote control signal light reception unit 25, the second control circuit 111 of the control circuit 112 instructs the red light source lighting circuit 104, the green light source lighting circuit 105, and the blue light source lighting circuit 106 to perform the lighting control of the light emitting elements 22R, 22G, and 22B on the basis of the predetermined value.

When only any one of the light emitting elements 22R, 22G, and 22B of the light source unit 2 of the lighting system is subject to the lighting control, and the light emitting elements 22N and 22L are not lighted, the control circuit 112 instructs the red light source lighting circuit 104, the green light source lighting circuit 105, and the blue light source lighting circuit 106 so as to turn off the light emitting elements 22R, 22G, and 22B, or lights thereof using the lower limit optical output in a controllable range, and is also able to instruct the red light source lighting circuit 104, the green light source lighting circuit 105, and the blue light source lighting circuit 106 so as to perform the lighting control of the light emitting elements 22N and 22L with the maximum light output in a controllable range, when the remote control-signal light receiving unit 25 of the control circuit 112 receives the signal of instructing the lighting control of the light source unit 2 based on the detection value of the optical sensor 6. In addition, it is also possible to light the light emitting elements 22N and 22L using the predetermined optical outputs, respectively.

Effects of the lighting system according to the example 2 are shown below.

The lighting device 3 of the lighting system according to the example 2 includes the effect of the lighting device 3 of the lighting system in the example 1, and includes the effect described below.

In the lighting system according to the example, the control circuit 112 controls the red light source lighting circuit 104, the green light source lighting circuit 105, and the blue light source lighting circuit 106 to perform the lighting control of the light emitting elements 22R, 22G, and 22B on the basis of the predetermined value at the time of operating the optical sensor 6, when there is a portion where the wavelength of any one of light of the light emitting elements 22R, 22G, and 22B which is determined by the half-value width, and the wavelength when the sensitivity of the optical sensor 6 determined by the half-value width La becomes a peak match each other, or are overlapped with each other, accordingly, when performing the lighting control of the light source unit 2 based on the detection value of the optical sensor 6, it is possible to control the brightness of the lighting space at which the lighting system is provided as the predetermined brightness without performing a malfunction due to a misdetection.

In the lighting system according to the example, since the control circuit 112 controls the red light source lighting circuit 104, the green light source lighting circuit 105, and the blue light source lighting circuit 106 to light the light emitting elements 22R, 22G, and 22B, using the lower limit optical output in a controllable range at the time of operating the optical sensor 6 even when there is no portion where the wavelength of any one of light of the light emitting elements 22R, 22G, and 22B which is determined by the half-value width, and the wavelength when the sensitivity of the optical sensor 6 determined by the half-value width La becomes a peak match each other, when the lighting control of the light source unit 2 based on the detection value of the optical sensor 6 is performed, it is possible to reliably prevent the malfunction due to the misdetection in advance, and to make the optical output be uniformly performed from the light emitting surface of the light source unit 2 without causing a dark section at the center portion (a portion on the circumference of the light source unit 2 where the light emitting elements 22R, 22G, and 22B are arranged) at which the light emitting elements 22N and 22L of the light source unit 2 are arranged in a double toric shape.

EXAMPLE 3

A lighting system according to an example 3a includes, a first light source which emits light the half-value width of which is 100 nm or more; a second light source which emits light the half-value width of which is less than 100 nm; a first lighting circuit which lights the first light source; a second lighting circuit which lights the second light source; a first optical sensor; a second optical sensor with a peak sensitivity at a wavelength which is different from that of the first optical sensor; and a control circuit which performs a lighting control of the first lighting circuit based on a detection value of the first optical sensor, or the second optical sensor, and performs a lighting control of the second lighting circuit based on a detection value of the first optical sensor, or the second optical sensor.

In a lighting system according to an example 3b, the control circuit of the lighting system in the example 3a includes a first control circuit to which a first optical sensor is connected, and performs a lighting control of a first lighting circuit, and a second control circuit to which a second optical sensor is connected, and performs a lighting control of a second lighting circuit.

Figure 19:
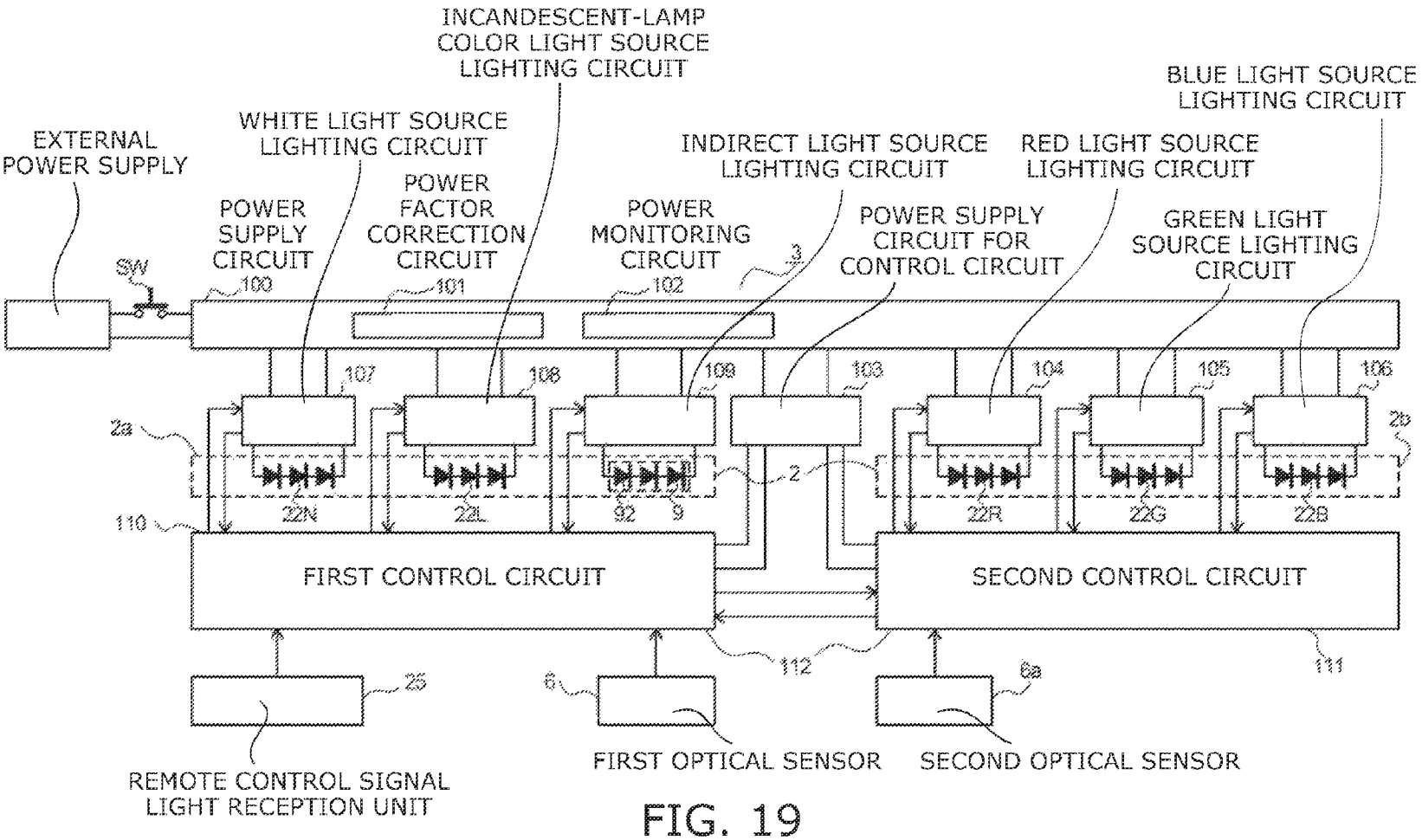
FIG. 19 is a configuration diagram which shows a circuit configuration of the lighting device of the lighting system according to the third example.

A circuit configuration and operations of a lighting device 3*a* of a lighting system according to the example 3 (example 3a, or 3b) will be described with reference to FIGS. 16 to 19. A curve (b) in FIG. 18 is an explanatory diagram which shows properties of an optical sensor 6*a* (a second optical sensor) of the lighting device 3 of the lighting system according to the example 3. FIG. 19 is a configuration diagram which shows a circuit configuration of the lighting device 3*a* of the lighting system according to the example 3. In addition, the same portions will be given the same reference numerals, and repeated descriptions will be omitted. The lighting system according to the example 3 has a structure which is shown in FIGS. 1 to 14, and has a circuit configuration of the lighting device 3 which is shown in FIGS. 16 to 19.

The properties of the optical sensor 6*a* of the lighting device 3 of the lighting system according to the example will be described with reference to FIG. 18.

The curve (b) in FIG. 18 shows a relationship between a sensitivity and wavelength of the optical sensor 6*a*. In addition, in the curve (b), the wavelength when the sensitivity of the optical sensor 6*a* becomes the peak may be determined using, for example, the half-value width Lb as shown in FIG. 18. The wavelength when the sensitivity which is determined using the half-value width Lb becomes the peak is referred to as the peak wavelength, hereinafter, the peak wavelength will be described as an example. As shown in FIG. 18, the peak wavelength of the optical sensor 6 is different from that of the optical sensor 6*a*.

When it is the lighting system according to the example 2, since the light source unit 2 includes the light emitting element 22R which emits the red light, the light emitting element 22G which emits the green light, and the light emitting element 22B which emits the blue light, there is a case where the wavelength of light of the light emitting element 22R, 22G, or 22B matches the peak wavelength. On the other hand, in the lighting system according to the example, since there is no portion where the peak wavelength of the optical sensor 6*a*, and the wavelengths of light of the light emitting element 22R, 22G, and 22B which are determined by the half-value width match each other, or are overlapped with each other, even when there is a portion where the wavelength of any one of light of the light emitting elements 22R, 22G, and 22B which are determined by the half-value width, and the wavelength when the sensitivity of the optical sensor 6 determined by the half-value width La becomes a peak match each other, or are overlapped with each other, it is possible to perform the lighting control of the light emitting elements 22 and 92 of the light source unit 2 at the time of operating the optical sensors 6 and 6*a*.

In addition, for example, even though there is a portion where the wavelength of the light of the light emitting element 22R which is determined by the half-value width, and the peak wavelength of the optical sensor 6 match each other, or are overlapped with each other, and a portion where the wavelengths of the light of the light emitting elements 22G and 22B which are determined by the half-value width, and the peak wavelength of the optical sensor 6*a* match each other, or are overlapped with each other, when the light emitting element 22R is subject to the lighting control based on the detection value of the optical sensor 6, and the light emitting elements 22G and 22B are subject to the lighting control based on the detection value of the optical sensor 6, it is possible to control the brightness of the lighting space at which the lighting system is provided to have a predetermined brightness with no malfunction due to misdetection.

A circuit configuration of a lighting device 3*a* of the lighting system according to the example will be described with reference to FIG. 19.

The lighting device 3*a* of the lighting system according to the example is the same as the lighting device 3 according to the examples 1 and 2 except that the optical sensor 6*a* is provided in the second control circuit 111.

An operation of the lighting device 3 of the lighting system according to the example 2 will be described with reference to FIGS. 16 to 19.

When a signal is sent from the remote control transmitter Rc so as to perform a lighting control of the light source unit 2 on the basis of a detection value of the optical sensors 6 and 6*a*, and the signal which is sent from the remote control transmitter Rc is received by the remote control signal light reception unit 25, the first control circuit 110 of the control circuit 112 controls the white light source lighting circuit 107 and the incandescent-lamp color light source lighting circuit 108 according to the detection value of the optical sensor 6, and the light emitting elements 22N and 22L are subject to the lighting control by the white light source lighting circuit 107 and the incandescent-lamp color light source lighting circuit 108 according to the detection value of the optical sensor 6, or 6*a*, the second control circuit 111 of the control circuit 112 controls the red light source lighting circuit 104, the green light source lighting circuit 105, and blue light source lighting circuit 106 according to the detection value of the optical sensor 6*a*, and the light emitting elements 22R, 22G, and 22B are subject to the lighting control by the red light source lighting circuit 104, the green light source lighting circuit 105, and the blue light source lighting circuit 106, respectively, according to the detection value of the optical sensors 6 and 6*a*.

The control circuit 112 controls the red light source lighting circuit 104, the green light source lighting circuit 105, and the blue light source lighting circuit 106, the white light source lighting circuit 107 and the incandescent-lamp color light source lighting circuit 108 so that the lighting space which is lighted by the lighting system has the predetermined brightness. When the natural light such as the sunlight is input to the lighting space, the optical sensors 6 and 6*a* detect the increase in the brightness of the lighting space, and the control circuit 112 controls the red light source lighting circuit 104, the green light source lighting circuit 105, and the blue light source lighting circuit 106, the white light source lighting circuit 107 and the incandescent-lamp color light source lighting circuit 108 on the basis of the detection value of the optical sensors 6 and 6*a*, and reduces the optical output of the light emitting elements 22N, 22L, 22R, 22G, and 22B. In addition, when the light amount of the natural light input to the lighting space is reduced, and the brightness thereof is decreased, the control circuit 112 controls the red light source lighting circuit 104; the green light source lighting circuit 105, and the blue light source lighting circuit 106, the white light source lighting circuit 107 and the incandescent-lamp color light source lighting circuit 108 on the basis of the detection value of the optical sensors 6 and 6*a* so that the lighting space has the predetermined brightness, and increases the optical output of the light emitting elements 22N, 22L, 22R, 22G, and 22B.

Effects of the lighting system according to the example 3 are shown below.

The lighting device 3 of the lighting system according to the example 3 includes the effects of the lighting device 3 of the lighting system according to the example 1, and effects of the lighting device 3 of the lighting system according to the example 2, and includes effects which are described below.

In the lighting system according to the example, since the optical sensors 6 and 6*a* have the peak sensitivity at different wavelengths from each other, and it is possible to perform the lighting control of the light emitting elements 22R, 22G and 22B based on the detection value of the optical sensors 6 and 6*a* without the malfunction due to the misdetection, and to control the brightness of the lighting space at which the lighting system is provided to have the predetermined brightness.

Hereinafter, modification examples in the first to third examples will be described.

The control circuits 112 of the lighting systems according to the first to third examples are able to be configured so as to light the light emitting elements 22N, 22L, 92, 22R, 22G, and 22B with a predetermined optical output, respectively, perform additive light mixing with respect to light which is output from light emitting elements, control the light source lighting circuit so that the optical output of the light source unit 2 becomes a predetermined color temperature, or a predetermined wavelength, and to perform the lighting control of the light emitting elements.

The predetermined color temperature of the optical output of the light source unit 2 which is obtained by performing the additive light mixing with respect to the light output from the light emitting element may be a temperature which gives a predetermined effect to a user of a lighting system, that is, a person present in the lighting space of the lighting system.

When changing the color temperature of the optical output of the light source unit 2 which is obtained by performing the additive light mixing with respect to the light output from the light emitting element, the control circuit 112 instructs the red light source lighting circuit 104, the green light source lighting circuit 105, and the blue light source lighting circuit 106 to control the respective light emitting elements 22R, 22G, and 22B with a rate of change in the optical output which is predetermined with respect to the light emitting elements 22R, 22G, and 22B.

Since the control circuits 112 of the lighting systems according to the first to third examples control the respective light emitting elements 22R, 22G, and 22B with the rate of change in the optical output which is predetermined with respect to the respective light emitting elements 22R, 22G, and 22B, when changing the color temperature of the optical output of the light source unit 2 which is obtained by performing the additive light mixing with respect to the light output from the light emitting element, it is possible to change the color temperature of the optical output of the light source unit 2 by a more simple control, and without giving an unpleasant feeling to a user of the lighting system.

In the light source units 2 of the lighting systems according to the first to third examples, the light emitting element 22N the luminous color of which is neutral white, and the light emitting element 22L the luminous color of which is the incandescent-lamp color are arranged alternately in a double toric shape at even intervals. In addition, the light emitting elements 22R, 22G, and 22B which respectively emit light of red, green, and blue are arranged on the circumference at even intervals in this order, in the middle of the double toric shape.

For this reason, even when only the light emitting elements 22N and 22L of the light source unit 2 are subject to the lighting control by the remote control transmitter Rc, the control circuits 112 of the lighting systems according to the examples 1 to 3 instruct the red light source lighting circuit 104, the green light source lighting circuit 105, and the blue light source lighting circuit 106 to control the light emitting elements 22R, 22G, and 22B with a predetermined optical output, for example, using the lower limit optical output in a controllable range so as not to cause a dark section at the center portion (a portion on the circumference of the light source unit 2 where the light emitting elements 22R, 22G, and 22B are arranged) at which the light emitting elements 22N and 22L of the light source unit 2 are arranged in a double toric shape.

Since the control circuits 112 of the lighting systems according to examples 1 to 3 instruct the red light source lighting circuit 104, the green light source lighting circuit 105, and the blue light source lighting circuit 106 so as to control the light emitting elements 22R, 22G, and 22B with a predetermined optical output, even when only the light emitting elements 22N and 22L of the light source unit 2 are subject to the lighting control by the remote control transmitter Rc, it is possible to perform a more uniform optical output from the light emitting surface of the light source unit 2 without causing a dark section at the center portion (a portion on the circumference of the light source unit 2 where the light emitting elements 22R, 22G, and 22B are arranged) at which the light emitting elements 22N and 22L of the light source unit 2 are arranged in a double toric shape.

The lighting device 3 or 3*a* of the lighting systems according to examples 1 to 3 includes a plurality of MPUs, or DSPs as the first control circuit 110 and the second control circuit 111 in the control circuit 112. By using the plurality of MPUs, or DSPs in the control circuit 112, it is possible to mount the MPU or DSP in the same process when mounting the circuit components 32 and the heating component 32H to the circuit board 31 in the lighting device 3 or 3*a*. That is, it is possible to configure the control circuit 112 by one MPU, or one DSP, however, in this case, the MPU, or DSP is mounted to the circuit board 31 by a reflow process, and the other circuit components 32 and the heating component 32H are mounted to the circuit board 31 by a flow process, accordingly, processes are increased, and the productivity is lowered.

On the other hand, since the lighting device 3, or 3*a* of the lighting system according to the examples 1 to 3 mounts the plurality of MPUs, or DSPs as the first control circuit 110 and the second control circuit 111 in the control circuit 112, it is possible to mount the plurality of MPUs, or DSPs to the circuit board 31 using the same flow process as the process of mounting the circuit components 32 and the heating component 32H to the circuit board 31, accordingly, the productivity is not harmed.

The lighting device 3, or 3*a* of the lighting system according to the examples 1 to 3 includes the first and second control circuits 110 and 111 in the control circuit 112, and there is a relationship of master-slave in which the first control circuit 110 grasps contents of control of the second control circuit 111. Since the control circuit 112 performs a communication between the first control circuit 110 (master) and second control circuit (slave), and the first control circuit 110 (master) grasps or manages a control state, or the contents of the control operation of the second control circuit (slave), it is possible to make a control sequence of the control circuit 112 simple, and to improve a speed of control processing of the control circuit 112 when the first and second control circuits 110 and 111 are the same MPU, or DSP.

The lighting device 3, or 3*a* of the lighting system according to the examples 1 to 3 has the relationship of master-slave in which the first control circuit 110 grasps the contents of control of the second control circuit 111, and when a control operation which is instructed to the second control circuit 111 from the first control circuit 110 is different from an actual control operation of the second control circuit 111, the first control circuit 110 transmits an operation mode change signal to the second control circuit 111 so as to perform the control operation instructed by the first control circuit 110 to the second control circuit 111. When the operation mode change signal is accompanied by a change in the lighting control of the light source unit 2, since the second control circuit 111 which received the operation mode change signal performs a change in the lighting control of the light source unit 2 using a fading function, even when the control operation instructed to the second control circuit 111 from the first control circuit 110 is different from the actual control operation of the second control circuit 111, and it is necessary to change the control operation, it is possible to provide a further comfortable lighting space without making a user of the lighting system recognize the change in the operation mode.

Some embodiments of the present invention have been described, however, these embodiments, or examples are merely examples, and are not limiting the scope of the invention. It is possible to embody these new embodiments, or examples in a variety of embodiments other than that, and may be omitted, substituted, changed without departing from the scope of the invention. These embodiment, examples, or the modification examples are included in the scope, or gist of the invention, and included in the invention disclosed in claims, and equivalent claims thereof.

What is claimed is:

1. A lighting system comprising:

a first light source with a predetermined color temperature;

a second light source with a color temperature which is different from that of the first light source;

a first lighting circuit configured to light the first light source;

a second lighting circuit configured to light the second light source;

a signal input unit configured to receive an external signal; and a control circuit including:

a first light source lighting control cycle performing a predetermined lighting control of the first light source; and a second light source lighting control cycle performing a predetermined lighting control of the second light source, the control circuit controlling the first and second lighting circuits so as to start the lighting control based on the first and second light source lighting control cycles by a first signal which is input to the signal input unit, and controlling the first and second lighting circuits so as to stop the lighting control based on the first and second light source lighting control cycles by a second signal which is input to the signal input unit.

2. The system according to claim 1, wherein the control circuit makes a ratio between an optical output of the first light source and an optical output of the second light source constant by the second signal which is input to the signal input unit when stopping a lighting control based on the first and second light source lighting control cycles, and performs a dimming control of the first and second light sources on the basis of a dimming signal which is input to the signal input unit keeping the ratio constant.

3. The system according to claim 1, wherein the control circuit stores control target values of the first and second light source lighting control cycles when the lighting control based on the first and second light source lighting control cycles is stopped by the second signal which is input to the signal input unit, and controls the first and second lighting circuits on the basis of the stored control target values of the first and second light source lighting control cycles by a third signal which is input to the signal input unit.

4. The system according to claim 2, wherein the control circuit stops the lighting control based on the first and second light source lighting control cycles by the second signal which is input to the signal input unit, stores the control target values of the first and second light source lighting control cycles after being performed with a dimming control, and controls the first and second lighting circuits on the basis of the stored control target values of the first and second light source lighting control cycles by a third signal which is input to the signal input unit.

5. The system according to claim 1, wherein the control circuit controls the second lighting circuit so that the optical output of the second light source decreases on the basis of the second light source lighting control cycle when the first lighting circuit is controlled so that the optical output of the first light source increases on the basis of the first light source lighting control cycle, and controls the second lighting circuit so that the optical output of the second light source increases on the basis of the second light source lighting control cycle when the first lighting circuit is controlled so that the optical output of the first light source decreases on the basis of the first light source lighting control cycle.

6. The system according to claim 1, further comprising:

a third light source which includes a color temperature different from those of the first and second light sources; and a third lighting circuit which lights the third light source, the control circuit further including a third light source lighting control cycle performing a predetermined lighting control of the third light source, the control circuit giving an instruction for simultaneously performing all of lighting controls of an increase control, a decrease control, and a constant control of the optical output by any one of the first, second, and third lighting circuits on the basis of the first, second, and third light source lighting control cycles by the first signal which is input to the signal input unit.

7. The system according to claim 1, wherein the control circuit performs a toning control of the first and second light sources on the basis of a signal which is,input to the signal input unit.

8. The system according to claim 7, wherein the control circuit stops the lighting control based on the first and second light source lighting control cycles by the second signal which is input to the signal input unit, stores control target values of the first and second light source lighting control cycles after being performed with the toning control, and controls the first and second lighting circuits on the basis of the stored control target values of the first and second light source lighting control cycles by a third signal which is input to the signal input unit.

9. The system according to claim 1, wherein the control circuit lights the first and second light sources at maximum optical output when the first signal is input after starting a lighting control based on the first and second light source lighting control cycles.

10. The system according to claim 1, further comprising:

a third light source including a color temperature which is different from those of the first and second light sources; and a third lighting circuit configured to light the third light source, the control circuit further including a third light source lighting control cycle which performs a predetermined lighting control of the third light source, the control circuit controlling the third lighting circuit so that an optical output of the third light source is reduced on the basis of the third light source lighting control cycle when the first lighting circuit is controlled so that the optical output of the first light source is increased based on the first light source lighting control cycle, controlling the second lighting circuit so that the optical output of the second light source is decreased on the basis of the second light source lighting control cycle when the first lighting circuit is controlled so that the optical output of the first light source is decreased based on the first light source lighting control cycle, and controlling the third lighting circuit so that an optical output of the third light source is increased on the basis of the third light source lighting control cycle when the second lighting control circuit is controlled so that the optical output of the second light source is reduced based on the second light source lighting control cycle.

11. The system according to claim 10, wherein the control circuit makes a ratio among an optical output of the first light source, an optical output of the second light source, and an optical output of the third light source constant by the second signal which is input to the signal input unit when stopping a lighting control based on the first, second, and third light source lighting control cycles, and performs a dimming control of the first, second, and third light sources on the basis of a dimming signal which is input to the signal input unit keeping the ratio constant.

12. A method of controlling a lighting system which includes a first light source with a predetermined color temperature, a second light source with a color temperature which is different from that of the first light source, a first lighting circuit which lights the first light source, a second lighting circuit which lights the second light source, the method comprising:

starting a lighting control controlling the first lighting circuit on the basis of a predetermined first light source lighting control cycle, and controlling the second lighting circuit on the basis of a predetermined second light source lighting control cycle, when a first signal is input; and stopping the lighting control on the basis of the first and second light source lighting control cycles when a second signal is input.

13. The method according to claim 12, wherein a ratio of an optical output of the first light source to an optical output of the second light source is made constant by the second signal when stopping the lighting control based on the first and second light source lighting control cycles, and the first and second lighting circuits are subject to a dimming control based on an input dimming signal keeping the ratio constant.

14. The method according to claim 12, wherein control target values of the first and second light source lighting control cycles are stored when stopping the lighting control based on the first and second light source lighting control cycles by the second signal, and the first and second lighting circuits are controlled based on the stored control target value of the first and second light source lighting control cycles by a third signal which is input.

15. The method according to claim 12, wherein the lighting controls based on the first and second light source lighting control cycles are stopped, and the control target values of the first and second light source lighting control cycles after being subject to a dimming control are stored when stopping the lighting control based on the first and second light source lighting control cycles by the second signal, and the first and second lighting circuits are controlled on the basis of the stored control target values of the first and second light source lighting control cycles by an input third signal.

16. The method according to claim 12, wherein the second lighting circuit is controlled so as to reduce the optical output of the second light source based on the second light source lighting control cycle when the first lighting circuit is controlled so as to increase the optical output of the first light source based on the first light source lighting control cycle, and the second lighting circuit is controlled so as to increase the optical output of the second light source based on the second light source lighting control cycle when the first lighting circuit is controlled so as to decrease the optical output of the first light source based on the first light source lighting control cycle.

17. The method according to claim 12, wherein the lighting system further includes a third light source having a color temperature different from those of the first and second light sources and a third lighting circuit configured to light the third light source, starting a lighting control which controls the third lighting circuit based on a predetermined third light source lighting control cycle when the first signal is input; and stopping the lighting control based on the third light source lighting control cycle when the second signal is input.

18. The method according to claim 12, wherein the first and second light sources are subject to a toning control based on an input signal.

19. The method according to claim 18, wherein the control target values of the first and second light source lighting control cycles after being subject to the toning control are stored when the lighting control based on the first and second light source lighting control cycles is stopped by the input second signal, and the first and second lighting circuits are controlled on the basis of the stored control target values of the first and second light source lighting control cycles, by the input third signal.

20. The method according to claim 12, wherein the first and second light sources are lighted at maximum light outputs when the first signal is input after starting the lighting control based on the first and second light source lighting control cycles.

* * * * *